US005262968A

United States Patent [19]

Coffield

[11] Patent Number: 5,262,968

[45] Date of Patent: Nov. 16, 1993

[54] HIGH PERFORMANCE ARCHITECTURE FOR IMAGE PROCESSING

[75] Inventor: Patrick C. Coffield, Shalimar, Fla.

[73] Assignee: The United States of America as represented by the Secretary of the Air Force, Washington, D.C.

[21] Appl. No.: 904,315

[22] Filed: Jun. 25, 1992

[51] Int. Cl.[5] ..... G06E 3/00; G06J 3/00

[52] U.S. Cl. ..... 364/604; 364/822

[58] Field of Search ..... 364/604, 713, 822; 382/49

[56] References Cited

U.S. PATENT DOCUMENTS

| | | | |
|---|---|---|---|
| 4,601,055 | 7/1986 | Kent | 382/49 |
| 4,695,973 | 9/1987 | Yu | 364/604 |
| 4,697,247 | 9/1987 | Grinberg et al. | 364/713 |
| 4,723,222 | 2/1988 | Becker et al. | 364/604 |
| 4,850,027 | 7/1989 | Kimmel | 382/49 |
| 4,967,340 | 10/1990 | Dawes | 364/200 |

*Primary Examiner*—Long T. Nguyen

*Attorney, Agent, or Firm*—Bernard E. Franz; Thomas L. Kundert

[57] ABSTRACT

The logical computer architecture is specifically designed for image processing, and other related computations. The architecture is a data flow concept comprising three tightly coupled components: a spatial configuration processor, a point-wise operation processor, and a accumulation operation processor. The data flow and image processing operations are directed by the control buffer and pipelined to each of the three processing components. The image processing operations are defined by an image algebra capable of describing all common image-to-image transformations. The merit of this architectural design is how elegantly it handles the natural decomposition of algebraic functions into spatially distributed, point-wise operations. The effect of this particular decomposition allows convolution to be computed strictly as a function of the number of elements in the template (mask, filter, etc.) instead of the number of pixels in the image. Thus, a substantial increase in throughput is realized. The logical architecture may take any number of physical forms, including a hybrid electro-optical implementation, and an all digital implementation. The potential utility of this architectural design lies in its ability to control all the arithmetic and logic operations of the image algebra's generalized matrix product. This is the most powerful fundamental formulation in the algebra, thus allowing a wide range of applications.

7 Claims, 7 Drawing Sheets

Given:
INPUT IMAGE $a$

| | | | | |
|---|---|---|---|---|
| 0 | 0 | 0 | 0 | 0 |
| 0 | 1 | 1 | 1 | 0 |
| 0 | 1 | 1 | 1 | 0 |
| 0 | 0 | 0 | 1 | 0 |
| 0 | 1 | 0 | 0 | 0 |
| 0 | 0 | 0 | 0 | 0 |

TEMPLATE $t$

| | | |
|---|---|---|
| | 2 | |
| 2 | 3 | 2 |
| | 2 | |

CONVOLUTION $a \oplus t$

| | | | | |
|---|---|---|---|---|
| 0 | 4 | 8 | 4 | 0 |
| 4 | 20 | 26 | 18 | 4 |
| 6 | 19 | 27 | 24 | 4 |
| 0 | 8 | 14 | 11 | 6 8 |
| 2 | 3 | 2 | 8 | 0 |
| 0 | 2 | 0 | 0 | 0 |

LET:

$t_1 = \boxed{1}$ ACC = 0

$t_2 = \boxed{1}$ $t_4 = \boxed{1}$ $t_3 = \boxed{1}$ $t_5 = \boxed{1}$ $a \oplus t_1$

| | | | | |
|---|---|---|---|---|
| 0 | 0 | 0 | 0 | 0 |
| 0 | 1 | 1 | 1 | 0 |
| 0 | 1 | 1 | 1 | 0 |
| 0 | 0 | 0 | 1 | 0 |
| 0 | 1 | 0 | 0 | 0 |
| 0 | 0 | 0 | 0 | 0 |

$ACC = W_1 = a \oplus t_1 \times 3$

| | | | | |
|---|---|---|---|---|
| 0 | 0 | 0 | 0 | 0 |
| 0 | 6 | 12 | 6 | 0 |
| 0 | 9 | 9 | 6 | 0 |
| 0 | 0 | 0 | 12 | 0 |
| 0 | 3 | 0 | 0 | 0 |
| 0 | 0 | 0 | 0 | 0 |

$a \oplus t_2$

| | | | | |
|---|---|---|---|---|
| 0 | 0 | 0 | 0 | 0 |
| 0 | 0 | 0 | 0 | 0 |
| 0 | 1 | 1 | 1 | 0 |
| 0 | 1 | 1 | 1 | 0 |
| 0 | 0 | 0 | 1 | 0 |
| 0 | 1 | 0 | 0 | 0 |

$W_2 = a \oplus t_2 \times 2$

| | | | | |
|---|---|---|---|---|
| 0 | 0 | 0 | 0 | 0 |
| 0 | 0 | 0 | 0 | 0 |
| 0 | 4 | 8 | 4 | 0 |
| 0 | 6 | 6 | 4 | 0 |
| 0 | 0 | 0 | 8 | 0 |
| 0 | 2 | 0 | 0 | 0 |

$ACC = ACC + W_2$

| | | | | |
|---|---|---|---|---|
| 0 | 0 | 0 | 0 | 0 |
| 0 | 6 | 12 | 6 | 0 |
| 0 | 13 | 17 | 10 | 0 |
| 0 | 6 | 6 | 16 | 0 |
| 0 | 3 | 0 | 8 | 0 |
| 0 | 2 | 0 | 0 | 0 |

$a \oplus t_3$

| | | | | |
|---|---|---|---|---|
| 0 | 0 | 0 | 0 | 0 |
| 0 | 0 | 1 | 1 | 1 |
| 0 | 0 | 1 | 1 | 1 |
| 0 | 0 | 0 | 0 | 1 |
| 0 | 0 | 1 | 0 | 0 |
| 0 | 0 | 0 | 0 | 0 |

$W_3 = a \oplus t_3 \times 2$

| | | | | |
|---|---|---|---|---|
| 0 | 0 | 0 | 0 | 0 |
| 0 | 0 | 4 | 8 | 4 |
| 0 | 0 | 6 | 6 | 4 |
| 0 | 0 | 0 | 0 | 8 |
| 0 | 0 | 2 | 0 | 0 |
| 0 | 0 | 0 | 0 | 0 |

$ACC = ACC + W_3$

| | | | | |
|---|---|---|---|---|
| 0 | 0 | 0 | 0 | 0 |
| 0 | 6 | 16 | 14 | 4 |
| 0 | 13 | 23 | 16 | 4 |
| 0 | 6 | 6 | 16 | 8 |
| 0 | 3 | 2 | 8 | 0 |
| 0 | 2 | 0 | 0 | 0 |

$a \oplus t_4$

| | | | | |
|---|---|---|---|---|
| 0 | 1 | 1 | 1 | 0 |
| 0 | 1 | 1 | 1 | 0 |
| 0 | 0 | 0 | 1 | 0 |
| 0 | 1 | 0 | 4 | 0 |
| 0 | 0 | 0 | 0 | 0 |
| 0 | 0 | 0 | 0 | 0 |

$W_4 = a \oplus t_4 \times 2$

| | | | | |
|---|---|---|---|---|
| 0 | 4 | 8 | 4 | 0 |
| 0 | 6 | 6 | 4 | 0 |
| 0 | 0 | 0 | 8 | 0 |
| 0 | 2 | 0 | 0 | 0 |
| 0 | 0 | 0 | 0 | 0 |
| 0 | 0 | 0 | 0 | 0 |

$ACC = ACC + W_4$

| | | | | |
|---|---|---|---|---|
| 0 | 4 | 8 | 4 | 0 |
| 0 | 12 | 22 | 18 | 0 |
| 0 | 13 | 23 | 24 | 4 |
| 0 | 8 | 6 | 16 | 8 |
| 0 | 3 | 2 | 8 | 0 |
| 0 | 2 | 0 | 0 | 0 |

$a \oplus t_5$

| | | | | |
|---|---|---|---|---|
| 0 | 0 | 0 | 0 | 0 |
| 1 | 1 | 1 | 0 | 0 |
| 1 | 1 | 1 | 0 | 0 |
| 0 | 0 | 1 | 0 | 0 |
| 1 | 0 | 0 | 0 | 0 |
| 0 | 0 | 0 | 0 | 0 |

$W_5 = a \oplus t_5 \times 2$

| | | | | |
|---|---|---|---|---|
| 0 | 0 | 0 | 0 | 0 |
| 4 | 8 | 4 | 0 | 0 |
| 6 | 6 | 4 | 0 | 0 |
| 0 | 0 | 8 | 0 | 0 |
| 2 | 0 | 0 | 0 | 0 |
| 0 | 0 | 0 | 0 | 0 |

$ACC = ACC + W_5 = a \oplus t$

| | | | | |
|---|---|---|---|---|
| 0 | 4 | 8 | 4 | 0 |
| 4 | 20 | 26 | 18 | 4 |
| 6 | 19 | 27 | 24 | 4 |
| 0 | 8 | 14 | 16 | 8 |
| 2 | 3 | 2 | 8 | 0 |
| 0 | 2 | 0 | 0 | 0 |

*Fig. 7*

HIGH PERFORMANCE ARCHITECTURE FOR IMAGE PROCESSING

RIGHTS OF THE GOVERNMENT

The invention described herein may be manufactured and used by or for the Government of the United States for all governmental purposes without the payment of any royalty.

BACKGROUND OF THE INVENTION

The present invention relates generally to a high performance architecture for image processing.

There are many processor architectures which have been designed for image processing applications. In general, such applications have been implemented as a limited set of specific user functions. All image processing operations can be fully described by unary, binary, and matrix operations defined in an image algebra developed at the University of Florida. Furthermore, no known design has been built which supports a mathematically rigorous image processing language robust enough to express all common image processing operations.

The image/signal processing community at large is continuously seeking new software methods, hardware/firmware implementations, and processor architectures that provide higher throughput rates. The higher throughput allows for more comprehensive algorithms to be processed. This is particularly true for military applications (i.e., advanced guidance for autonomous weapons). Nearly all processing methodologies presently capable of being fielded (miniaturized and hardened) for military use have throughput ratings in term of millions of operations per second (Mega Ops). Even with these processing speeds certain image processing tasks cannot be accomplished within a systems total response time (i.e., the time necessary for a system to respond to a change in input information).

The following United States patents are of interest.

U.S. Pat. No. 4,967,340—Dawes

U.S. Pat. No. 4,850,027—Kimmel

U.S. Pat. No. 4,697,247—Grinberg et al

U.S. Pat. No. 4,601,055—Kent.

Dawes discloses an adaptive processing system for signal processing which includes a random access processor having an array of processing elements each being individually configurable. The latter appears to be the equivalent of a spatial configuration process component. Dawes appears to disclose an accumulation process component in the last paragraph of column 3 but appears to be lacking in any teaching of a point-wise operation process component. Kimmel is concerned with a computer system for image processing. The middle of column 5 of Kimmel discloses that the term "image" is used in the broadest sense, covering spatially or temporarily related information. The top of column 5 of Kimmel discusses the fact that the prior art discloses the use of image algebra in an image processor and that operations which do not involve the states of a pixel's neighbors may be performed in a separate point-by-point logic section to simplify the neighborhood logic circuit. Kimmel appears to be deficient in any teaching of an accumulation process component. Grinberg et al disclose a logical computer architecture for image processing which has means for representing spatially distributed data values, processing the data at every point in the image, and accumulating spatially distributed resultant values. Kent discloses an iconic-to-iconic image processor adapted to maintain spatial representation of images while performing a number of point and neighborhood operations. There is no discussion of an accumulation process component.

SUMMARY OF THE INVENTION

An objective of the invention is to provide a logical design for a high throughput, parallel processor architecture. Another objective is to provide an architecture capable of directly executing image processing operations defined by the image algebra developed at the University of Florida under Air Force contract number F08635-84-C-0295.

The invention relates to a logical computer architecture designed for image and signal processing and other related computations. The architecture comprises three components: a spatial configuration processor, a point-wise operation or weighting processor, and an accumulation processor. Use of a particular Air Force developed algebra allows a wide range of applications and the design makes possible a processing speed and general application unknown to other devices or designs.

ADVANTAGES OF THE INVENTION

1. The merit of this architectural design is how elegantly it handles the natural decomposition of algebraic functions into spatially distributed point wise operations. The effect of this particular decomposition allows convolution type operations to be computed strictly as a function of the number of elements in the template (convolution mask) instead of the number of pixels in the image.

2. This invention captures the most fundamental construct (formulation) in the underlying image algebra, the generalized matrix product, thus allowing a wide range of applications. Shifting the image to each of the discrete template displacements configures the resulting image space. The remaining two point-wise (array) processes are in one-to-one correspondence with the two binary associative operators defined by the generalized matrix product.

3. The result of this logical architecture in this invention is an extremely fast processor which performs all the binary associative operations defined in the semigroup of the image algebra. The processing throughput is equivalent to "tera-op" ($10^{12}$ operations per second) performance of conventional, reduced set computer architectures.

4. The uniqueness of the logical design allows the implementation to take any number of physical forms; i.e. VLSI and hybrid electro-optical.

5. No other known device or design has made this claim of direct mapping to a heterogeneous image algebra, generalized image processing, and extremely high throughput.

BRIEF DESCRIPTION OF THE DRAWING

FIG. 7 is a diagram showing an example of general convolution;

DETAILED DESCRIPTION

The image algebra developed by the University of Florida under Air Force contract number F08635-84-C-0295 is described in a technical report AFATL-TR-88-125 titled "The Image Algebra Project—Phase II" by Gerhard X. Ritter et al, for the Air Force Armament Laboratory (now part of Wright Laboratory), Eglin Air Force Base, Florida, available from DTIC and NTIS as number AD-A204 419, hereby incorporated by reference; and in G. X. Ritter, "Recent Developments in Image Algebra", published in *Advances in Electronics and Electron Physics*, Vol. 80, pages 243-308, 1991 by Academic Press, Inc., also hereby incorporated by reference. A copy of the report and the text are enclosed with this application as filed.

The image processing architecture is described in papers by Patrick C. Coffield, one titled "An Electro optical Image Processing Architecture for Implementing Image Algebra Operations" in Proceedings of SPIE's International Symposium on Optical Applied Science and Engineering Jul. 21-26, 1991, San Diego, Calif., Volume Number 1568—Image Algebra and Morphological Image Processing II; and another titled "A High Performance Image Processing Architecture" in Proceedings of SPIE/IS&T's Symposium on Electronic Imaging Science & Technology, Feb. 9-14, San Jose, Calif., Conference Number 1659—Image Processing: Implementation and Systems. Another paper titled "An Architecture For Processing Image Algebra Operations" will be presented by Patrick C. Coffield, in Proceedings of SPIE's International Symposium on Optical Applied Science and Engineering, Jul. 19-24, San Diego, Calif., Volume Number 1769—Image Algebra and Morphological Processing III. These three papers are hereby incorporated by reference, and copies are enclosed as part of the application as filed.

Figure 1:
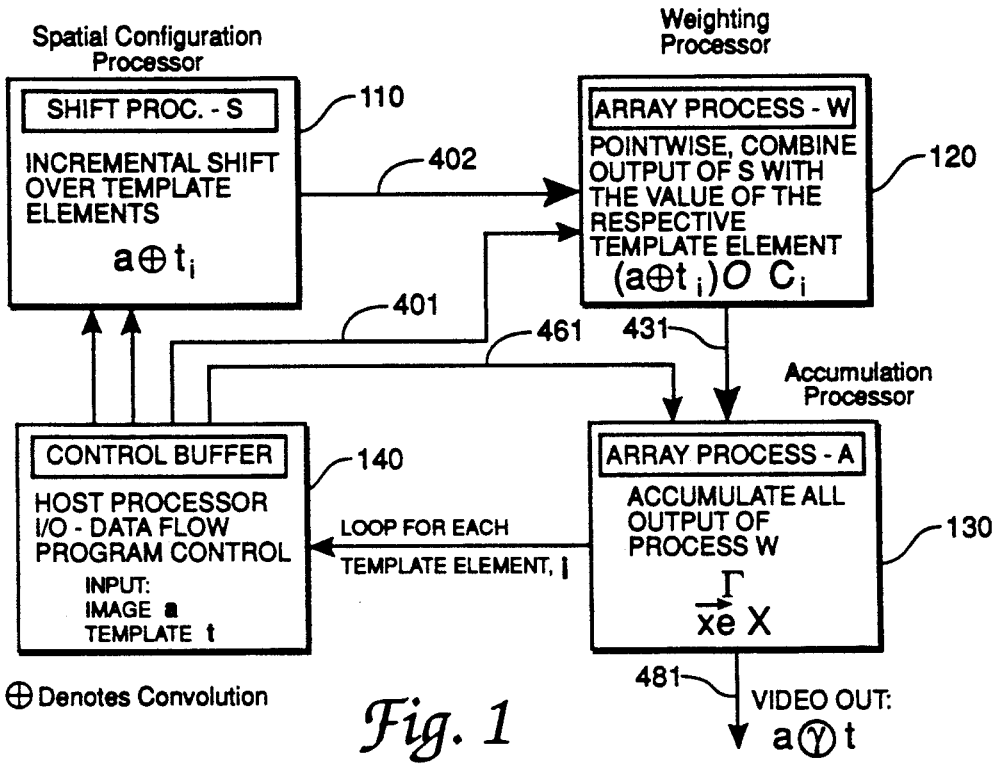
FIG. 1 is a block diagram of a high performance architecture for image processing, which is also a data flow diagram.
Figure 2:
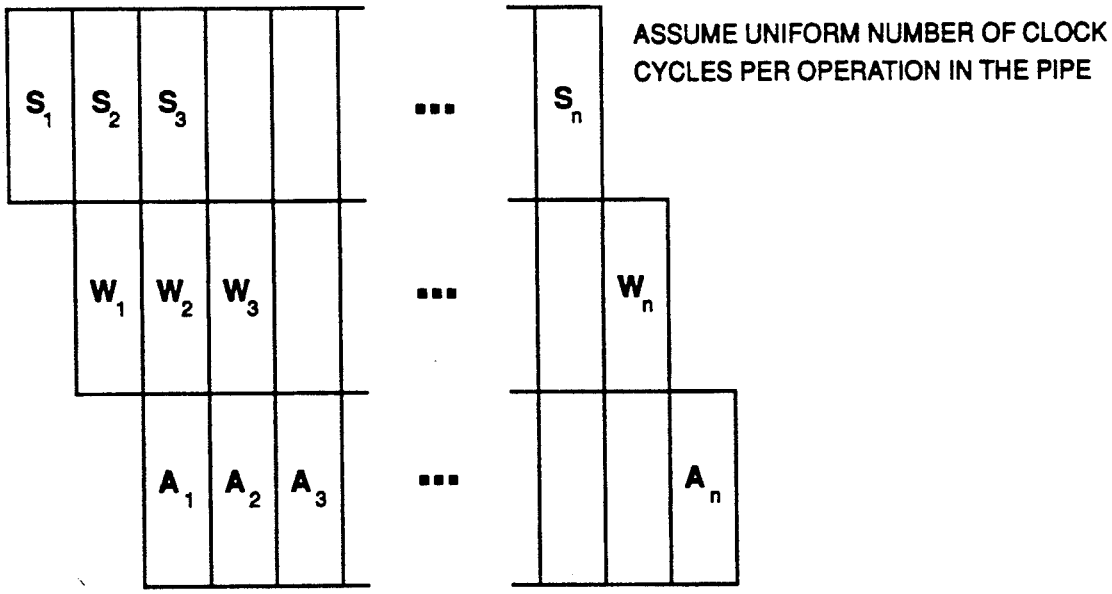
FIG. 2 is a diagram showing pipelining the processors.

The logical computer architecture described here is specifically designed for image and signal processing, and other related computations. As shown in FIG. 1, the architecture is a data flow concept comprising three tightly coupled components: a spatial configuration processor 110 (process S), a weighting processor 120 using a point-wise operation (process W), and a accumulation operation processor 130 (process A). The data flow and image processing operations are directed by the control buffer 140 and pipelined to each of the three processing components, as shown in FIG. 2.

Figure 6:
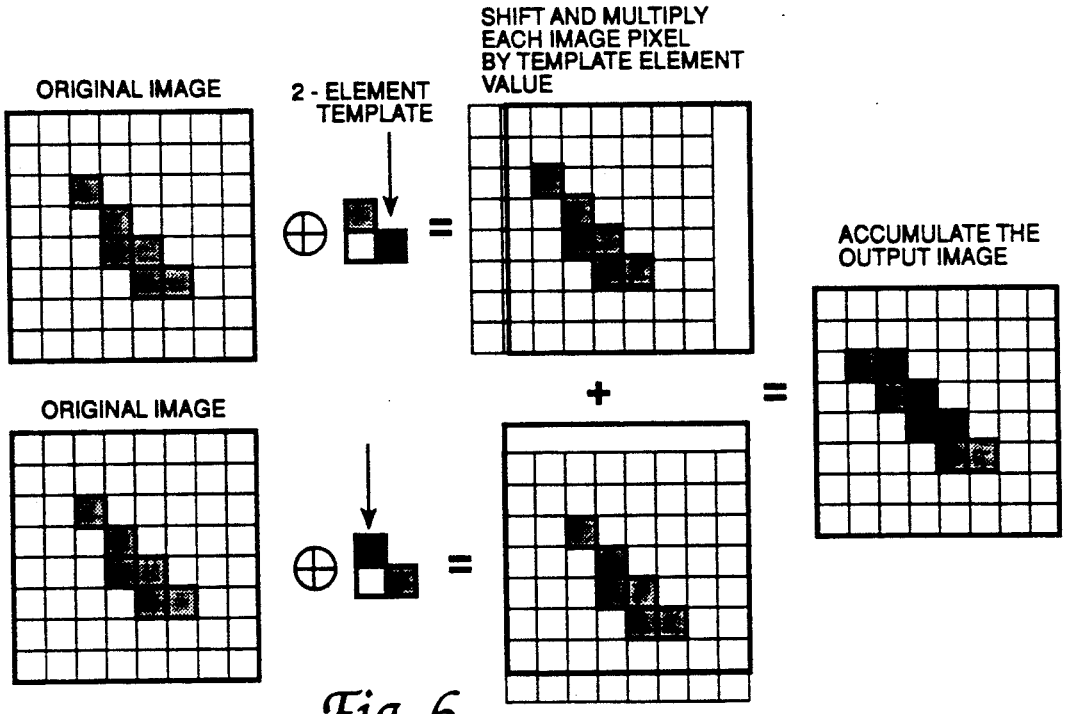
FIG. 6 is a diagram showing an example of shift/-combine operations.

The spatial configuration process is a step-wise discrete convolution of the original input image with each template location. A unit value is assigned to the template element for each convolution. The result of each convolution is simply a shift of the input image element, as shown in FIG. 6.

The output of the spatial configuration processor is combined point-wise in the weighting processor 120, using the appropriate binary associative operator from the algebraic set of operators, with the value of the respective template element. This point-wise operation processor 120 is a typical array processor execution with the binary associative operators assigned to each arithmetic logic unit.

The output of the point-wise operation process is now accumulated point-wise, using the appropriate global reduce operator from the algebraic set of operators. Once the final template element is processed in this fashion, the accumulator memory contains the result of the generalized matrix product defined in the algebra. Note, the generalized matrix product is the mathematical formulation for operations such as: general convolution/correlation, additive maximum/minimum, and multiplacative maximum/minimum. These operations along with the direct image-to-image (strictly a point-wise process) unary and binary operations allow for the formulation of all common image processing tasks. Hence, this architecture will control the execution of all necessary operations of the underlying image algebra.

For the hybrid electro-optical embodiment, the spatial configuration processor 110 is a Fourier optical correlator design using binary and high resolution ($2^8$ bits) spatial light modulator technology (e.g. Ferroelectric Liquid Crystal, Smectic A-FLC) and a charged coupled device (CCD array) to provide the output image in digital form, with a high frame switching frequency. It provides a step-wise optical convolution of the original input image with each template location.

The weighting processor 120 is a parallel array processor with directly connected input from the CCD array of the spatial configuration processor 110, and with the capability to load a scalar value to each arithmetic logic unit (ALU). Three parallel shift registers are needed for each ALU. Each ALU must have a multiplier, an adder, and a modified comparator shown in FIG. 3. The output image will be the result of combining the input image with the scalar using one of the following operations: +; .; <; >; (AND); and (OR).

Figure 3:
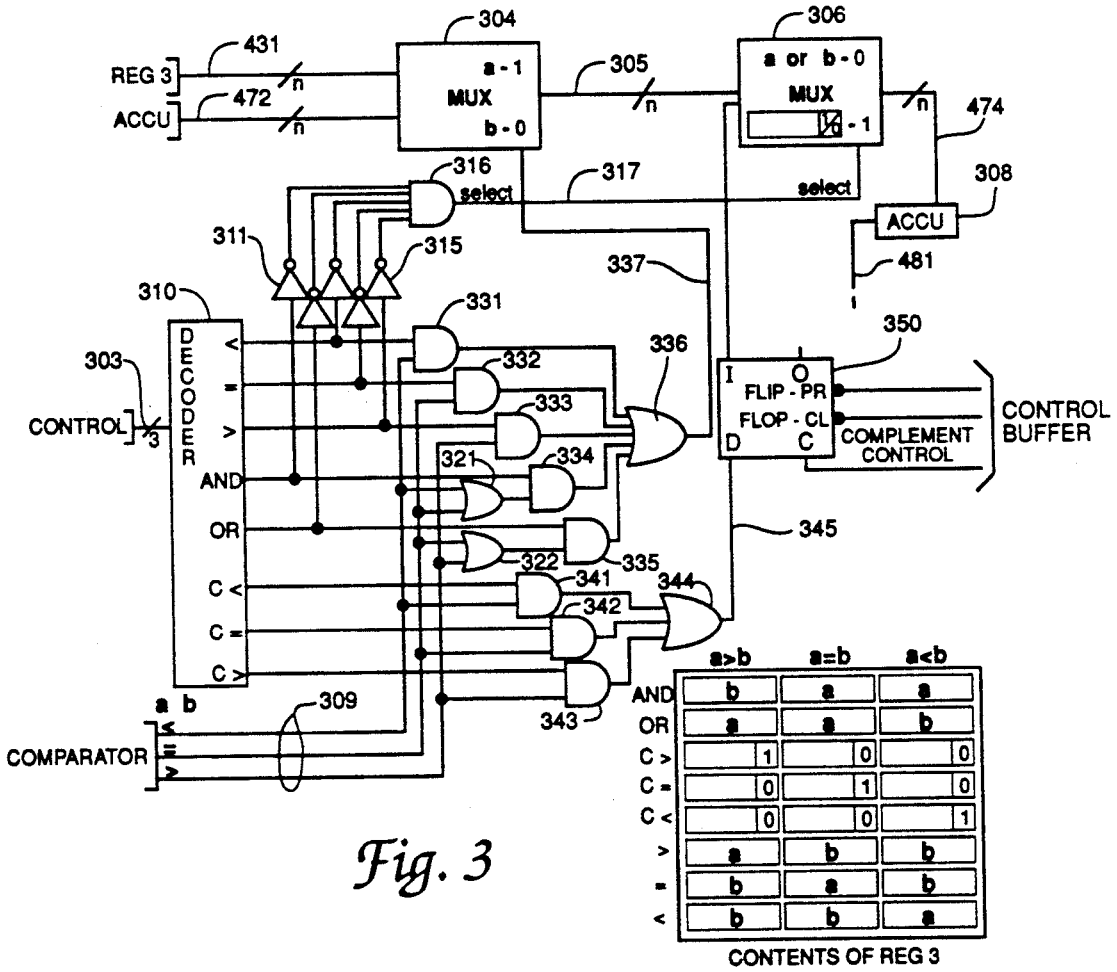
FIG. 3 is a functional block diagram showing comparator enhancement.

Parallel Shift Register—Definition: Refer to [20] Roth, C. H., *Fundamentals of Logic Design*, West Publishing Co., St. Paul, Minn. 1979 for a complete description of a parallel-in, parallel-out shift register (74178 TTL). This particular shift register, shown in FIG. 3c, has two control inputs, shift enable and load enable. If shift enable is high (load enable, don't care), then clocking the register results in the serial input to be shifted into the first flip-flop, any data already in the flip-flops will be shifted right, and the serial output will be on the last flip-flop. For parallel I/O the shift enable is set low while the load enable is set high. This causes the n data input lines to be loaded in parallel, simultaneously and contents of the flip-flops will be output in parallel. If both control lines are low, then clocking the register causes no change of state.

Figure 3A:
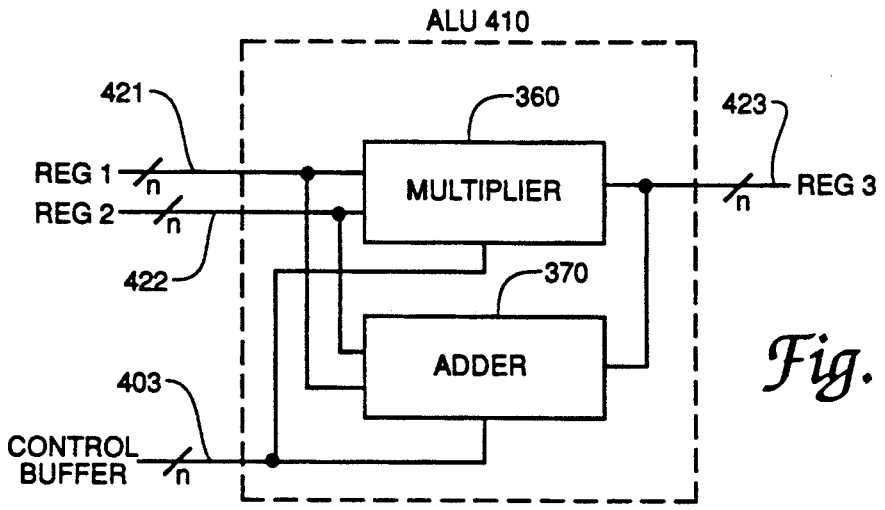
FIG. 3*a* is a block diagram of an ALU 410.

A block diagram of an ALU 410 for the weighting processor 120 is shown in FIG. 3a. It comprises a multiplier 360 and an adder 370. The n-bit lines 421 and 422 from first and second registers respectively are connected to both of these units, and the outputs from both units are connected via the n-bit line 423 to a third register 413. The unit to be used for any operation is selected by signals from the control buffer on the two-bit line 403.

Figure 3B:
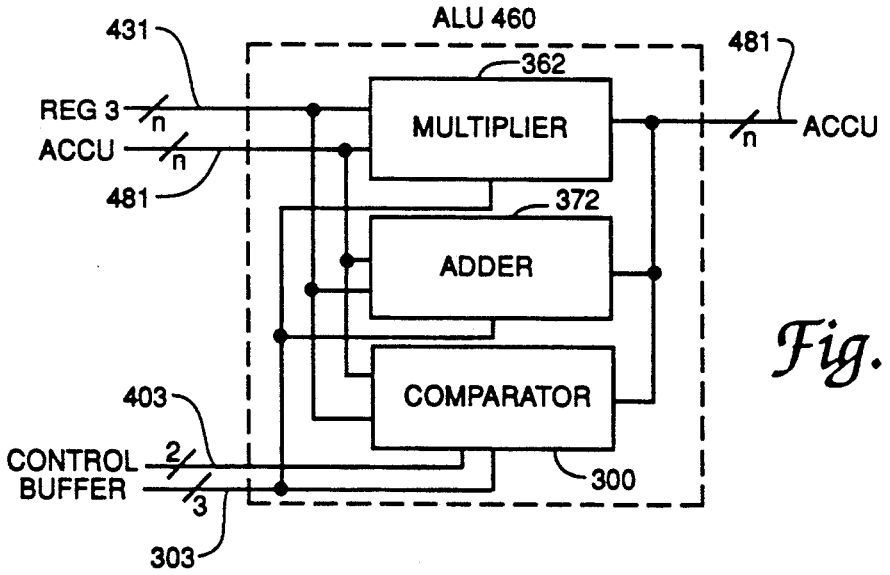
FIG. 3*b* is a block diagram of an ALU 460.
Figure 3C:
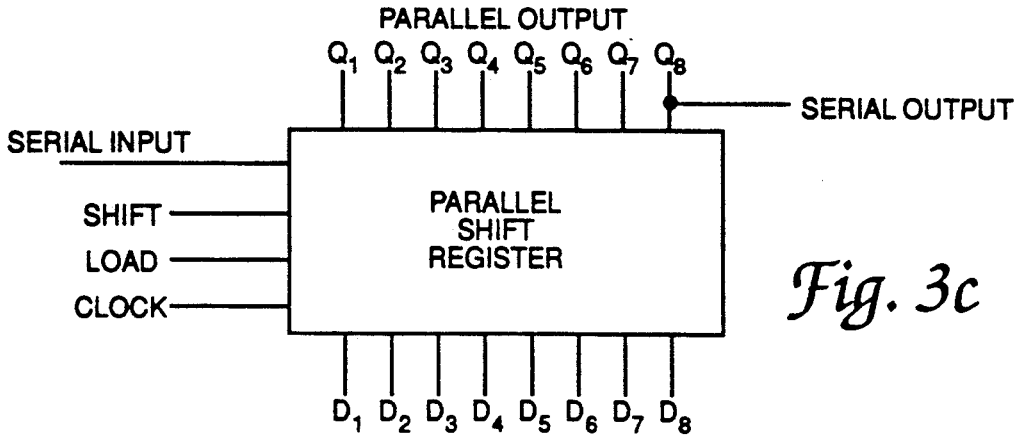
FIG. 3c is a block diagram of a parallel shift register.

A block diagram of an ALU 460 for the accumulation processor 130 is shown in FIG. 3*b*. In addition to the comparator 300 of FIG. 3, it includes a multiplier 362 and an adder 372. The n-bit lines 431 and 481 from the third register 413 and the accumulator 480 respectively are connected to all three of these units, and the outputs from all three units are connected via the n-bit line 481 to the video output. The unit to be used for any operation is selected by signals from the control buffer.

Figure 4:
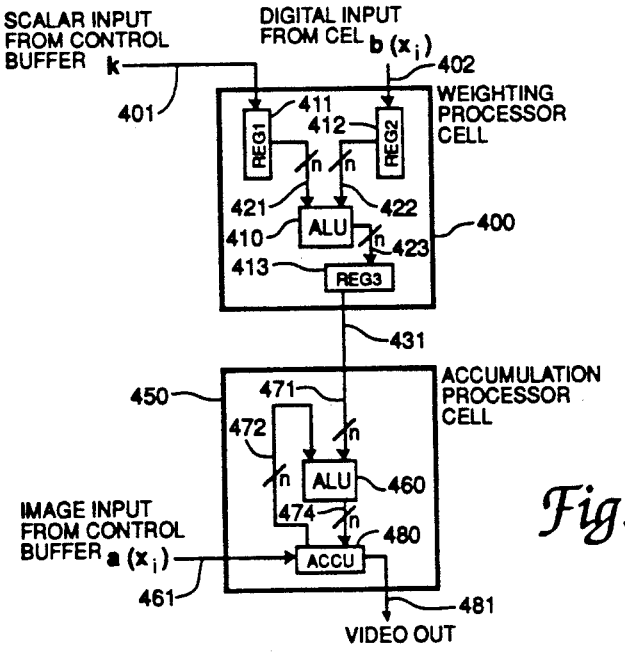
FIG. 4 is a diagram showing cellular connection of processors.

One of the plurality of weighting processor cells for the weighting processor 120 is shown in FIG. 4 as block 400. The ALU for this cell is shown as block 410. The first parallel shift register 411 has an a scalar input k from the control buffer 140 on line 401 (single bit line shifted in), and a parallel output on an n-bit line 421 to the ALU 410. The second parallel shift register 412 has an a digital input from cell $b(x_i)$ from the spatial configuration processor 110 on line 402 (single bit line shifted in), and a parallel output on an n-bit line 422 to the ALU 410. The third parallel shift register 413 has an n-bit parallel input from the output of the ALU 410, and a parallel output on an n-bit line 431 to the ALU 460.

The accumulation processor 130 is a parallel processor with directly connected input from the weighting processor 120. Each ALU will be configured identical to those in the weighting processor with the addition of an accumulator. One of the plurality of accumulation processor cells for the accumulation processor 130 is shown in FIG. 4 as block 450. The ALU for this cell is shown as block 460. It has a parallel input on line 431 from the ALU 410 in the weighting processor 120. The output from the ALU 460 is coupled via an n-bit line 474 to an accumulator 480. There is an n-bit line 472 connected from the accumulator 480 to a second input of the ALU 460. The accumulator 480 can be loaded directly from the control buffer 140 with an image input $a(x_i)$ using a no-shift control on the shift processor and add zero on the ALU 410. The accumulated value (video out) on line 481 will be the result of combining the two images using one of the seven operations described above.

Figure 5:
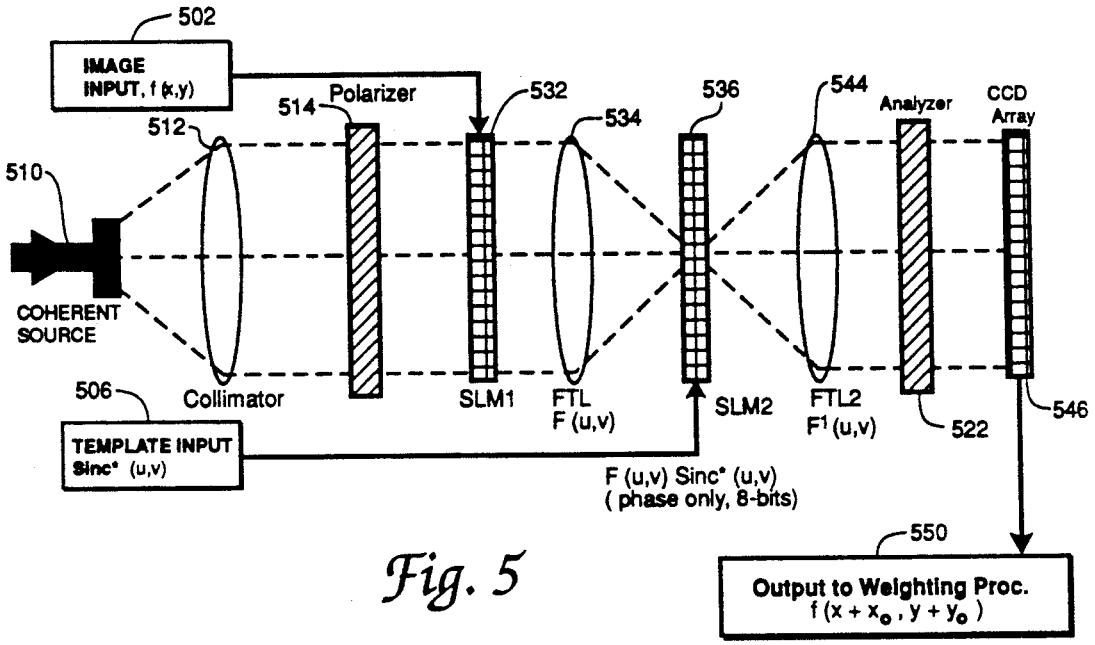
FIG. 5 is a diagram showing an optical convolver (analog)

FIG. 5 shows, conceptually, a spatial configuration processor 110 which is an optical system for controlling the input of each template element. It comprises a coherent light source 510 providing a light beam which passes through a collimator 512 then to a polarizer 514. The output of polarizer 514 is a plane wave of polarized coherent light. The plane wave can now interact with a first spatial light modulator (SLM1) 532. An image input f(x,y) from the control buffer 140, represented by block 502, provides digital electronic signals to the modulator 532. The phase modulated output of modulator 532 is passed to a Fourier transform lens (FTL) 534. The light energy is again phase modulated by a second spatial light modulator (SLM2) 536. A template input Sinc*(u,v) from the control buffer 140, represented by block 506, provides digital electronic signals to the second spatial light modulator 536. The phase distortion information (input via a lookup table in the control buffer) is simply the complex conjugate of a square pulse with unit amplitude, referred to as a sinc function. A change in frequency transforms (A Fourier transform pair) to a translation in the spatial domain. This is precisely what happens when the light energy is passed through the second Fourier transform lens (FTL) 544. As the shifted image information is output from FTL 544 it is passed through an analyzer (polarizer) 522 which modifies the intensity of the phase; modulated light. The differing levels of intensity are intercepted by a CCD array 546 and converted back to digital form. The output of the CCD array 546 provides the output of the spatial configuration processor 110 as a digital electronic signal, represented as a block 550, as the output to the weighting processor 120.

Figure 9:
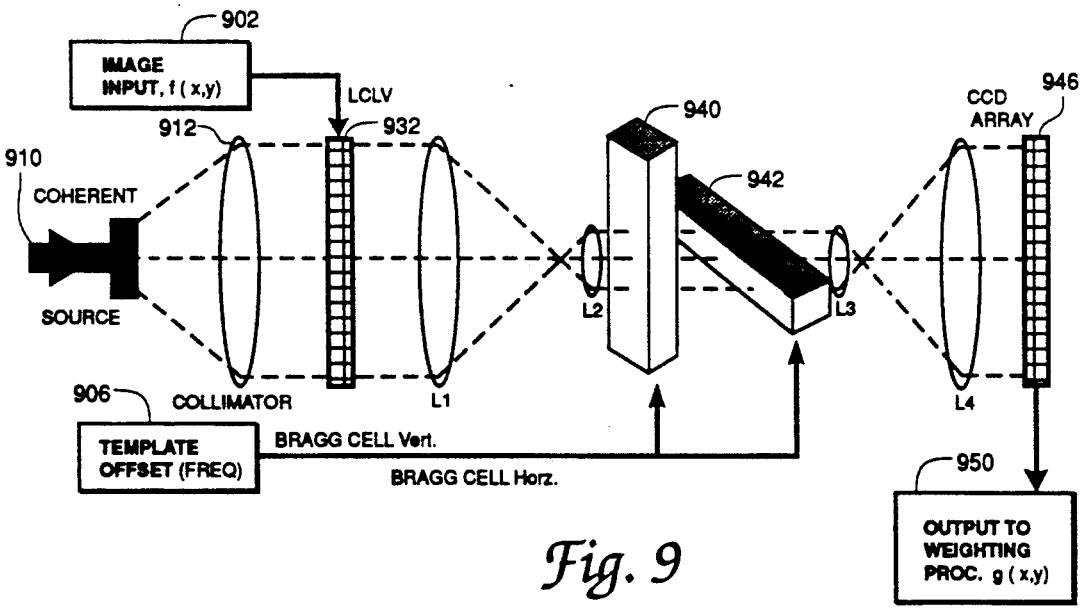
FIG. 9 is a diagram showing acousto-optical translation (analog)

An acousto-optical implementation of a spatial configuration processor is shown in FIG. 9. It comprises a coherent light source 910 providing a light beam which passes through a collimator 912. The beam is sent via a liquid crystal light valve 932 and lenses L1 and L2 to acousto-optical devices 940 and 942, and thence via lenses L3 and L4 to a CCD array 946. An image input f(x,y) from the control buffer 140, represented by block 902, provides digital electronic signals to the liquid crystal light valve 932. A template offset input from the control buffer 140, represented by block 906, provides digital electronic signals as Bragg cell vertical signals to device 940, and Bragg cell horizontal signals to device 942. The output of the CCD array 946 provides the output of the spatial configuration processor as a digital electronic signal, represented as a block 950, as the output to the weighting processor 120.

The devices labeled 940 and 942 are referred to as Bragg cells. They are crystal devices that respond in a manner of Bragg's Law where the angular displacement of a light beam is directly proportional to the frequency of an orthogonal sound source (acousto-optical principle).

In the interaction of a light and sound beam; where each is collimated, coherent, and orthogonal; the light beam is refracted as the peaks and valleys of the acoustic pressure wave pass through the light beam. The effect is used in optical deflectors and control devices for lasers. By pairing these devices 90 degrees apart, as shown in FIG. 9, the image can be translated in two dimensions.

The generalized matrix operations (or template-to-image operations) along with the direct image-to-image unary and binary operations allow for the formulation of all common image processing tasks. Hence, this architecture will control the execution of all the necessary set operations of the underlying image algebra.

IMAGE PROCESSING ARCHITECTURE AND OPERATIONS

The following part of the specification provides a more detailed description of the image processing architecture and the operations performed. Numbers in square brackets [ ] refer to the list of references at the end of the specification.

The proposed architecture is a logical design for image processing and other related computations. The design is a hybrid electro-optical concept comprising three tightly coupled components shown in FIG. 1: the spatial configuration processor 110 (the optical analog portion), the weighting processor 120 (digital), and the accumulation processor 130 (digital). The systolic flow of data and image processing operations are directed by the control buffer 140 and pipelined to each of the three processing components.

The image processing operations are defined by the algebra developed by the University of Florida. The algebra is capable of describing all common image-to-image transformations. The merit of this architectural design is how elegantly it handles the natural decomposition of algebraic functions into spatially distributed, point-wise operations. The effect of this particular decomposition allows convolution type operations to be computed strictly as a function of the number of elements in the template (mask, filter, etc.) instead of the number of picture elements in the image. Thus, a substantial increase in throughput is realized. The logical architecture may take any number of physical forms. While a hybrid electro-optical implementation is of primary interest, the benefits and design issues of an all digital implementation are also discussed. The potential utility of this architectural design lies in its ability to control all the arithmetic and logic operations of the image algebra's generalized matrix product. This is the most powerful fundamental formulation in the algebra, thus allowing a wide range of applications.

1.0. INTRODUCTION

The objective of this paper is to define the logical configuration of a computer architecture designed specifically for image processing. The architecture is established to optimize the operations and functionality of an image algebra developed by the University of Florida under Air Force contract F08635-84-C-0295 [10]. It is in the further interest of the Air Force that such an architecture may be useful for advanced guidance systems that depend upon very high-speed image analysis.

The low-level abstraction of the proposed computational system is founded on the mathematical principle of discrete convolution and its geometrical decomposition. The geometric decomposition combined with array processing requires redefining specific algebraic operations and reorganizing their order of parsing in the abstract syntax. The logical data flow of such an abstraction leads to a division of operations, those defined by point-wise operations, the others in terms of spatial configuration.

The physical implementation can range from a general use coprocessor configuration coupled with an image processing work station to an embedded, dedicated processor detailed to a specific task. Since the design involves such a comprehensive set of operations, it is reasonable to assume that any implementation would have a wide range of commercial applications (e.g., medical imaging, manufacturing robotics, and independent research and development).

2.0. BACKGROUND

2.1. Image Processing Requirements

The recent war in the Persian Gulf was the first use of what are termed "smart weapons." As a result of the success of this generation of smart weapons, the projection is for even smarter more intelligent weapon platforms. Autonomous guidance systems based on image processing and understanding can provide the higher levels of intelligence that will be required.

There are many processor architectures which have been designed for image processing applications. In general, such applications have been implemented as a limited set of specific processing routines. All image processing operations can be fully described by the unary, binary, and matrix operations defined in the aforementioned image algebra. No prior architectural design has ever been developed to directly support the functionality of the image algebra. Furthermore, no known design has been built which supports a mathematically rigorous processing language robust enough to express all common image processing transforms.

Many application algorithms involving image analysis and processing are CPU or I/O bound, or both; i.e., an algorithm may be less robust due to limitations on processor or data bandwidths. Even considering the hardware speedup due to developments in VLSI components and CMOS technology, many algorithm tasks still require throughputs that are beyond current capabilities. Parallel computer architectures have the capability to overcome many of these bandwidth limitations; however, the communication among processors is a physical constraint that is not easily or inexpensively overcome.

Optical systems, on the other hand, have such a high space-bandwidth product that these limitations appear insignificant. In the past, the inherent inaccuracies of these analog systems have limited the use of such devices almost exclusively to correlation operations. The interest in these correlator operations is mainly the magnitude and location of the cross-correlation of an image scene with a reference subimage (usually an object to be identified in the input image scene). A large signal to noise ratio can be tolerated in this system and still provide acceptable auto-correlation position information.

Recent advances in spatial light modulator design have reduced optical system inaccuracies and increased their switching speeds to the point where they are now viable for the hybrid system described in this paper [18]. The approach taken here does use the matched filter/-correlator principle. However, it is simply taking advantage of the high space-bandwidth product of the optics to provide a fundamental convolution procedure which quickly and efficiently translates the input image.

The most important consideration is the mathematical structure of an algorithm. For instance, is the mathematical structure of an application algorithm optimized for whatever level of parallelism there may be in the architecture? The logical architecture defined in this paper provides the necessary optimization, but it does so at the operator level of the algebraic abstraction. This allows the algorithm designer to be creative at the conceptual level without regard to how the parallelism is physically mapped to the underlying architecture.

2.2. Image Algebra Overview

In recent years, several image algebras have been developed [1,2,3, 4]. These algebras are for the most part homogeneous (a finite number of operations for transforming one or more elements of a single set into another element of the same set). The mathematics of image processing, in the most general sense, forms a heterogeneous algebra (an algebra that involves operations on and between elements of different sets). If a homogeneous algebra and a heterogeneous algebra are isomorphic, then the homogeneous algebra can be considered as a subalgebra of the heterogeneous algebra. This defines the heterogeneous algebra as being "more powerful than" the homogeneous subalgebra; i.e., an algebra can define every thing its subalgebra can and more.

The image algebra (referred to as such throughout this paper, defined by Ritter et. al.) is a true heterogeneous algebra capable of expressing all image processing transforms in terms of its many different operations over a family of sets, its operands [5]. It manifests itself as an investigation of the interrelationship of two broad mathematical areas, point sets (subsets of topological spaces) and value sets (subsets of algebraic structures; e.g., groups, rings, vector spaces, lattices, etc.). The algebraic manipulation and transformation of geometric/spatial information is the basis for the interrelationship. The transformation of geometric data may result in geometric, statistical, or syntactic information represented by images. The point and value sets along with images and templates form the basic types of operands for the algebraic structure. Operations on and between images are the natural induced operations of the algebraic system. Operations between images and templates and between templates and templates are based on the definition of a generalized product [28].

Isomorphisms have been proven to exist between the image algebra and the homogeneous algebras previously mentioned [10]. Even more noteworthy, the image algebra has been proven to be isomorphic with Linear Algebra and Mini-Max Algebra [7,14]. The image algebra operations, both unary and binary, are not only capable of defining commonly used transforms, but higher levels of processing as well; i.e., neural networking, feature space manipulation, etc. [10]. A complete description of the image algebra can be found in [5].

2.2.1. Value Sets and Point Sets

In image algebra, value sets are synonymous with algebras. For a definition of an algebra, refer to [28]. An arbitrary value set will be defined by $\mathbb{F}$. Some of the more common examples of value sets used in image processing are the sets of integers, real numbers, complex numbers, binary numbers of fixed length k, and extended real numbers (which include one or both of the symbols $+\infty$ and $-\infty$). These value sets are denoted by $\mathbb{I}$, $\mathbb{R}$, $\mathbb{C}$, $\mathbb{I}_{2k}$, $\mathbb{R}_{+\infty}=\mathbb{R}\cup\{+\infty\}$, $\mathbb{R}_{-\infty}=\mathbb{R}\cup\{-\infty\}$, and $\mathbb{R}_{\pm\infty}=\mathbb{R}_{+\infty}\cup\mathbb{R}_{-\infty}$, respectively. The operations on and between elements of a given value set $\mathbb{F}\in\{\mathbb{I},\mathbb{R},\mathbb{C},\mathbb{I}_{2k},\mathbb{R}_{+\infty},\mathbb{R}_{-\infty},\mathbb{R}_{\pm\infty}\}$ are the usual arithmetic and lattice operations associated with $\mathbb{F}$ [10]. For example, the operations on the elements of the value set $\mathbb{F}$, where $\mathbb{F}=\mathbb{R}$, are the arithmetic and logic operations of addition, multiplication, and maximum, and the complementary operations of subtraction, division, and minimum. The operations on subsets of $\mathbb{F}$ are the operations of union, intersection, set subtraction, choice function and cardinality function, denoted by $\cup$, $\cap$, $\setminus$, choice and card, respectively. The choice function returns an arbitrary element of the subset of $\mathbb{F}$ while the cardinality function returns the number of elements in the subset of $\mathbb{F}$ [5].

In image algebra, the notion of a point set is equivalent with that of a topological space. Point sets most applicable to present day image processing tasks are subsets of n-dimensional Euclidean space $\mathbb{R}^n$. These point sets provide the flexibility of defining rectangular, hexagonal, toroidal, spherical, and parabolic discrete arrays as well as infinite subsets of $\mathbb{R}^n$ [12]. The letters X, Y and W denote point sets and elements of point sets are denoted by bold lower case letters to represent vectors in $\mathbb{R}^n$. In particular, if $x\in X$ and $X\subset\mathbb{R}^n$, then $x=(x_1, x_2, \ldots, x_n)$, where $x_i\in\mathbb{R}\ \forall\ i$. Image algebra operations acting on subsets of point sets are the operations of $\cup$, $\cap$, $\setminus$, choice choice and card. The operations acting on or between elements of point sets are the usual operations between coordinate points; i.e., vector addition, scalar and vector multiplication, dot product, etc. [5].

2.2.2. Images

An image is the most fundamental operand in the image algebra and is defined in terms of value sets and point sets. Given point and value sets X and $\mathbb{F}$, respectively, an $\mathbb{F}$ valued image a on X is the graph of a function $a:X\rightarrow\mathbb{F}$. Thus, an $\mathbb{F}$ valued image a on X is of the form $$a=\{(x,a(x)):x\in X\}, \tag{1}$$

where $a(x)\in\mathbb{F}$.

The set X is called the set of image points of a and the range of the function a (which is a subset of $\mathbb{F}$) is the set of image values of a. The pair (x,a(x)) is called a pixel, where x is the pixel location of the pixel value a(x). The set of all $\mathbb{F}$ valued images on X is denoted by $\mathbb{F}^X$ [5].

2.2.3. Operations on Images

The fundamental operations on and between $\mathbb{F}$ valued images are the naturally induced operations of the algebraic structure of the value set $\mathbb{F}$; in particular, if $\mathbb{F}=\mathbb{R}$, then the induced operations on $\mathbb{R}^X$ are the pixel-wise binary and unary operations of addition, multiplication, maximum, minimum, absolute value, exponentiation, etc. These pixel-wise operations will be executed by the weighting and accumulation processors of the proposed architecture [10].

2.2.4. Generalized Templates

A generalized template is a mathematical entity that generalizes the concepts of templates, masks, windows and structuring elements thereby playing an important role in expressing image transformations. They provide a tool for describing image operations where each pixel value in the output image depends on the pixel values within some predefined configuration of the input image [5, 11].

Let X and Y be point sets and $\mathbb{F}$ a value set. A generalized $\mathbb{F}$ valued template t from Y to X is a function $t:Y\rightarrow\mathbb{F}^X$. Thus, for each $y\in Y$, t(y) is an $\mathbb{F}$ valued image on X. The set of all $\mathbb{F}$ valued templates is denoted by $(\mathbb{F}^X)^Y$. The sets Y and X are referred to as the target domain and the range space of t, respectively. For notational convenience, $t_y$ is defined as, $t_y=t(y)$. The pixel location y at which a template $t_y$ is evaluated is called the target point of t and the values $t_y(x)$ are called the weights of t at y [5, 7].

If t is a real valued template from Y to X, then the support of $t_y$ is defined by $L(t_y)=\{x\in X:t_y(x)\neq 0\}$. If t is an extended real valued template, then the following supports are defined at infinity $$L_{\infty}(t_y)=\{x\in X:t_y(x)\neq\infty\},$$

$$L_{-\infty}(t_y)=\{x\in X:t_y(x)\neq-\infty\},$$

and $$L_{\pm\infty}(t_y)=\{x\in X:t_y(x)\neq\pm\infty\}$$

Templates are classified as either translation invariant or translation variant. Translation invariance is an important property because it allows image processing algorithms and transformations that make use of invariant templates to be easily mapped to a wide variety of computer architectures [11]. Suppose $X=\mathbb{R}^n$ or $X=\mathbb{I}^n$. A template $t\in(\mathbb{F}^X)^X$ is said to be translation invariant if and only if for each triple $x, y, z\in X$, $t_y(x)=t_{y+z}(x+z)$. Translation invariant templates have fixed supports and fixed weights and can be represented pictorially in a concise manner. A template which is not translation invariant is called translation variant, or simply a variant template. These templates have supports that vary in shape and weights that vary in value according to the target point [5,15].

2.2.5. Operations Between Images and Templates

Several common uses of image-template operations as defined in the image algebra are to describe image transformations that make use of local and global convolutions and to change the dimensionality or size and shape of images, image rotation, zooming, image reduction, masked extractions and matrix multiplication. In an effort to generalize the definition of basic operations between images and templates, the global reduce operation and the generalized product between an image and a template are introduced [5].

Let $X \subset \mathbb{R}^n$ be finite, where $X=\{x_1, x_2, \ldots, x_m\}$. If $\gamma$ is an associative and commutative binary operation on the value set $\mathbb{F}$, then the global reduce operation $\Gamma$ on $\mathbb{F}^X$ induced by $\gamma$ is defined by $$\Gamma a=\Gamma a(x)=a(x_1)\gamma a(x_2)\gamma \ldots \gamma a(x_m),\ x \in X \tag{2}$$

where $a \in \mathbb{F}^X$ and $\Gamma$ is the mapping function $\Gamma$: $\mathbb{F}^X \rightarrow \mathbb{F}$.

Image-template operations are defined by combining an image and a template with the appropriate binary operation. This is accomplished by means of the generalized product, specifically, the generalized backward and forward template operations [5,7]. Let $\mathbb{F}_1$, $\mathbb{F}_2$ and $\mathbb{F}$ be three value sets and o: $\mathbb{F}_1 \times \mathbb{F}_2 \rightarrow \mathbb{F}$ be a binary operation. If $\gamma$ is an associative and commutative binary operation on $\mathbb{F}$, $a \in \mathbb{F}_1^X$ and $t \in (\mathbb{F}_2^X)^Y$, then the generalized backward template operation (the generalized forward template operation is omitted here) of a with t is the binary operation $\textcircled{\gamma}$: $\mathbb{F}_1^X \times (\mathbb{F}_2^X)^Y \rightarrow \mathbb{F}^Y$ defined by $$a \textcircled{\gamma} t = \left\{ (y, b(y)): b(y) = \underset{x \in X}{\Gamma} a(x) o t_y(x),\ y \in Y \right\}. \tag{3}$$

Notice that the input image a is an $\mathbb{F}_1$ valued image on the point set X while the output image b is an $\mathbb{F}$ valued image on the point set Y. This is true regardless of whether the backward or forward template operation is used. Templates can therefore be used to transform an image with range values defined over one point set to an image on a completely different point set with entirely different values from the original image [5,7].

A wide variety of image-template operations can be derived by substituting various binary operations for $\gamma$ and o in the definitions stated above for the generalized backward and forward template operations [5]. However, there are three basic image-template operations defined in the image algebra that are sufficient for describing most image transformations encountered in current areas of image processing and computer vision applications. The three basic operations are generalized convolution, additive maximum, and multiplicative maximum, and are denoted by $\oplus$, $\boxtimes$, and $\textcircled{\vee}$ respectively (each one, along with its induced operations, will replace $\textcircled{\gamma}$). The operation $\oplus$ is a linear operation that is defined for real and complex valued images. The other two operations, $\boxtimes$ and $\textcircled{\vee}$, are nonlinear operations which may be applied to extended real valued images [5,7].

Let $X \subset \mathbb{R}^n$ be finite and $Y \subset \mathbb{R}^m$. If $a \in \mathbb{R}^X$ and $t \in (\mathbb{R}^X)^Y$, then the backward generalized convolution (the forward direction is omitted here) is defined as $$a \oplus t = \left\{ (y, c(y)): c(y) = \sum_{x \in X} a(x) \cdot t_y(x),\ y \in Y \right\}. \tag{4}$$

If $a \in \mathbb{R}_{-\infty}^X$ and $t \in (\mathbb{R}_{-\infty}^X)^Y$, then the backward additive maximum operation is defined as $$a \boxtimes t = \left\{ (y, c(y)): c(y) = \bigvee_{x \in X} a(x) + t_y(x),\ y \in Y \right\}, \tag{5}$$

where $$\bigvee_{x \in X} a(x) + t_y(x) = \max\{a(x) + t_y(x): x \in X\}.$$

If $a \in (\mathbb{R}_{-\infty}^{\geq 0})^X$ and $t \in ((\mathbb{R}_{-\infty}^{+})^X)^Y$, then the backward multiplicative maximum operation is defined as $$a \textcircled{\vee} t = \left\{ (y, c(y)): c(y) = \bigvee_{x \in X} a(x) \cdot t_y(x),\ y \in Y \right\}. \tag{6}$$

The complementary operations of additive and multiplicative minimum ($\boxtimes$ and $\textcircled{\vee}$) are defined in terms of the additive and multiplicative dual of images and templates and the image-template operations of $\boxtimes$ and $\textcircled{\vee}$ [5].

2.2.6. Operations Between Generalized Templates

The basic binary operations between generalized templates are the same point wise operations inherent in the value set $\mathbb{F}$ [7]. These are the same operations defined between images.

The image-template operations of $\oplus$, $\boxtimes$, and $\textcircled{\vee}$ generalize to operations between templates. When used as template-template operations, these image algebra operations enable large invariant templates to be decomposed into smaller invariant templates thereby providing a means for mapping image transformations to various computer architectures [15]. This process is called template decomposition. Combining two or more templates with the operations of $\oplus$, $\boxtimes$ and/or $\textcircled{\vee}$ is called template composition.

3.0. SYSTEM DESIGN 3.1. The Logical Architecture

The image/signal processing community at large is continuously seeking new software methods, hardware/firmware implementations, and processor architectures that provide higher throughput rates. The higher throughput allows for more computationally intensive algorithms to be processed. This is particularly true for military applications (i.e., advanced guidance for autonomous weapons). Nearly all processing methodologies presently capable of being fielded (miniaturized and hardened) for military use have throughput ratings in terms of millions of operations per second (MOPS). Even with these processing speeds, certain image processing tasks cannot be accomplished within a system's total response time.

The logical computer architecture described here is specifically designed for image processing and other matrix related computations. The architecture is a hybrid electro-optical concept consisting of three tightly coupled components: a spatial configuration processor; a weighting processor; and an accumulation processor (see FIG. 1). The flow of data and image processing operations are directed by a control buffer and pipelined to each of the three processing components (see FIG. 2). Table 1, presents a component level description for the operations required of each processing element.

TABLE 1

| Component | Component design requirements. Design Requirement |
|---|---|
| Spatial configuration processor | A Fourier optical correlator design using binary and high resolution ($2^8$bits) spatial light modulator technology (ferroelectric liquid crystal, smectic A-FLC) and a charged couple device (CCD array) to provide the output image in digital form-overall switching frequency-40 KHz. |
| Weighting processor | A parallel array processor with directly connected input from the CCD array and the capability to load a given scalar value to each arithmetic logic unit (ALU). Three parallel shift registers are needed for each ALU. Each ALU must have a multiplier, an adder, and a modified comparator, FIG. 3. The output image will be the result of combining the input image with the scaler using one of the following operations: +; ·; <; =; >; (AND); and (OR), FIG. 4. [10] |
| Accumulation processor | A parallel array processor with directly connected input from the weighting processor. Each ALU will be configured identical to those in the weighting processor with the addition of one parallel shift register and an accumulator (see FIG. 4). The accumulator can be loaded directly from the control buffer. The accumulated value (video out) will be the result of combining the two images using one of the seven operations described above. |
| Control buffer | This is the host controller (e.g., a workstation CPU) that directs all I/O handling and data flow. A translator/compiler must be designed or modified to parse the specific instructions required to interpret the algebraic syntax and direct the execution of the other components (refer to section 5). |

The spatial configuration processor is a step-wise optical convolution of the original input image with each template location. FIG. 5 shows, conceptually, an optical system for controlling the input of each template element. A unit value is assigned to the template element for each convolution. Thus, a sinc function is formed and is inherently multiplied in the frequency domain. The result of each convolution is simply a shift of the input image (each picture element, pixel, is shifted by the displacement of the respective template element, see FIG. 6). If the operation being directed by the control buffer is an image-to-image operation (i.e., strictly a point-wise operation), then the input images are sent directly to the array processor controlling the accumulation operation.

The output of the spatial configuration processor is combined point-wise, using the appropriate binary associative operator from the algebraic set of operators, with the value of the respective template element. This weighting procedure is performed on a digital array processor (weighting processor) using the binary associative operators assigned to each arithmetic logic unit (FIG. 4.). The output of the weighting processor is now accumulated point-wise using the appropriate global reduce operator from the algebraic set of operators. Again, this procedure is performed using a digital array processor (accumulation processor). Once the final template element is processed in this fashion, the accumulator memory contains the result of the generalized matrix product defined in the algebra. Note, the generalized matrix product is the mathematical formulation for operations such as: general convolution/correlation, additive maximum/minimum, and multiplicative maximum/minimum.

The generalized matrix operations (or template-to-image operations) along with the direct image-to-image unary and binary operations allow for the formulation of all common image processing tasks. Hence, this architecture will control the execution of all the necessary set operations of the underlying image algebra.

3.2. Image Algebra Process Distribution

All image-to-image operations are performed point-wise in one-to-one correspondance with respective pixels. Table 2., shows each operation and the corresponding data flow or process distribution.

TABLE 2

| Image Algebra | Image-to-image operations. Process Distribution |
|---|---|
| k + a | parallel step 1: load the value k into all ALU's in the weighting processor and image a into the accumulation processor; parallel step 2: accumulate ∋ c(x) = k + a(x)↕ |
| k · a | parallel step 1: load the value k into all ALUs in the weighting processor and image a into the accumulation processor; parallel step 2: accumulate ∋ c(x) = k · a(x)↕ |
| a + b | parallel step 1: load the accumulation processor with image a and the weighting processor with image b (no shift); parallel step 2: accumulate ∋ c(x) = a(x) + b(x) |
| a − b | parallel step 1: load the accumulation processor with image a and the weighting processor with image -b (no shift): parallel step 2: accumulate ∋ c(x) = a(x) + (-b(x)) |
| a · b | parallel step 1: load the accumulation processor with image a and the weighting procesoor with image b (no shift); parallel step 2: accumulate ∋ c(x) = a(x) · b(x) |
| a / b | parallel step 1: load the accumulation processor with image a and the weighting processor with image $b^{-1}$(no shift); parallel step 2: accumulate ∋ c(x) = a(x) · $b^{-1}$(x), where c(x) = 0 when $b^{-1}$(x) = 0 |
| a ∩ b | parallel step 1: load the accumulation processor with binary image a and the weighting processor with binary image b (no shift); parallel step 2: use the boolean output of each comparator ∋ c(x) = a(x) (AND) b(x) |
| a ∪ b | parallel step 1: load the accumulation processor with binary image a and the weighting processor with binary image b (no shift); parallel step 2: use the boolean output of each comparator ∋ c(x) = a(x) (OR) b(x) |
| a ∨ b | parallel step 1: load the accumulation processor with image a and the weighting processor with image b (no shift); parallel step 2: accumulate using the comparator ∋ if [a(x) > b(x)], c(x) = a(x), else c(x) = b(x) |
| a ∧ b | parallel step 1: load the accumulation processor with image a and the weighting processor with image b (no shift); parallel step 2: accumulate using the comparator ∋ if [a(x) < b(x)], c(x) = a(x), else c(x) = b(x) |
| $a^{-1}$ | ↕ |
| $a^c$ | Flip-flop 350 in FIG. 3 provides a hardware control for this action |
| −a | parallel step 1: load the value -1 into all ALUs in the weighting processor and image a into the accumulation processor; parallel step 2: accumulate ∋ c(x) = -1 · a(x)↕ |
| $\sqrt{a}$ | ↕ |

TABLE 2-continued

| Image Algebra | Image-to-image operations. Process Distribution |
|---|---|
| \|a\| | load the accumulation processor with image a, and mask the appropriate sign control bit for the accumulated value‡ |
| $\log_a b$ | ‡ |
| $a^b$ | ‡ |
| $e^a$ | ‡ |
| cos a, sin a, tan a | ‡ |
| $\cos^{-1}a$, $\sin^{-1}a$, $\tan^{-1}a$ | ‡ |

‡ This operation may be processed more efficiently using a high-speed sequential processor/math accelerator provide by the control buffer.

Characteristic functions, as they are defined in the image algebra, apply their respective conditional arguments to an image and output a binary image consisting of 1's where the condition is true, and 0's elsewhere. By properly tailoring the boolean output of a comparator's circuit, each conditional argument can be processed (FIG. 3). Table 3, shows the algebraic notation and the corresponding data flow or process distribution.

TABLE 3

| Image Algebra | Characteristic functions. Process Distribution |
|---|---|
| $\chi_{>b}(a)$ | parallel step 1: load the accumulation processor with image a and the weighting processor with image b (no shift, if instead of image b a scalar value m is used, simply load all ALUs with m); parallel step 2: accumulate the boolean output of each comparator for the > condition, w.r.t. b (or m) |
| $\chi_{<b}(a)$ | parallel step 1: load the accumulation processor with image a and the weighting processor with image b (no shift, if instead of image b a scalar value m is used, simply load all ALUs with m); parallel step 2: accumulate the boolean output of each comparator for the < condition, w.r.t. b (or m) |
| $\chi_{\geqq b}(a)$ | accumulate $\ni c = [\chi_{<b}(a)]^c$, |
| $\chi_{\leqq b}(a)$ | accumulate $\ni c = [\chi_{>b}(a)]^c$, |
| $\chi_{=b}(a)$ | parallel step 1: load the accumulation processor with image a and the weighting processor with image b (no shift, if instead of image b a scalar value m is used, simply load all ALUs with m); parallel step 2: accumulate the boolean output of each comparator for the = condition |
| $\chi_{\neq b}(a)$ | accumulate $\ni c = [\chi_{=b}(a)]^c$, |
| $\chi_{[m,n]}(a)$ | parallel step 1: accumulate image $b = \chi_{\geqq m}(a)$ and store in control buffer; parallel step 2: accumulate image $c = \chi_{\leqq n}(a)$ and load the weighting processor with b (no shift); parallel step 3: accumulate $\ni c = b \cdot c$ |

The global reduce operations $\Sigma a$; $\vee a$; $\wedge a$; $\| a$; for $\mathbb{F} = \mathbb{I}_{2k}$, $\gamma$=OR: $\Gamma a$; and, for $\mathbb{F} = \mathbb{I}_{2k}$, $\gamma$=AND: $\Gamma a$ transform an image to a scalar. Since the proposed architecture does not consist of a mesh or any interconnection among pixels, these operations are best performed by the host (e.g., a sequential processor/math accelerator).

The image algebra basically defines templates in two ways; invariant, where neither the template's point set nor its values set changes with respect to the target point; and variant, where the above constraint is not true for either or both sets. Since the proposed architecture must know the configuration (point set) of the template a priori, only invariant templates can be accommodated. Table 4, shows the algebraic notation for image-to-template operations and their corresponding data flow or process distribution.

TABLE 4

| Image Algebra | Image-to-template operations. Process Distribution |
|---|---|
| $a \oplus t$ | parallel step 1: load image a into the analog processor; parallel step 2: load the spatial location of template t into the analog processor and the value of template t into all ALUs of the weighting processor; parallel step 3: combine the output of the analog processor with the contents of the weighting processor using the · operation; parallel step 4: accumulate the output of the weighting processor using the + operation $\ni c = c + (a \oplus t_i)$; parallel step 5: repeat steps 2 through 5 $\forall$ i $\in$ the template configuration (pipeline) |
| $a \textcircled{\vee} t$ | same as $a \oplus t$, except the $\vee$ operation replaces the + operation in step 4 |
| $a \textcircled{\wedge} t$ | same as $a \oplus t$, except the $\wedge$ operation replaces the + operation in step 4 |
| $a \boxtimes t$ | same as $a \oplus t$, except the + operation $\vee$ replaces the · operation in step 3 and the operation replaces the + operation in step 4 |
| $a \boxtimes t$ | same as $a \oplus t$, except the + operation replaces the · operation in step 3 and the $\wedge$ operation replaces the + operation in step 4 |

The image algebra operations that have been shown to distribute over the proposed architecture represent a substantial increase in throughput and efficiency (refer to section 4.5). They also represent a very rich subset of the image algebra, powerful enough to accomplish all common image-to-image transforms.

4.0. PRELIMINARY RESULTS 4.1. Proof of Concept

Recall the following image algebra definitions: the global reduce function; equation 2, $$\Gamma a = \underset{x \in X}{\Gamma} a(x) = a(x_1)\gamma a(x_2)\gamma \ldots \gamma a(x_n),$$

the generalized matrix product; equation 3, $$a \textcircled{\vee} t = \left\{ (y, b(y)) : b(y) = \underset{x \in X}{\Gamma} a(x) o t_y(x),\ y \in Y \right\},$$

the general convolution; equation 4, $$a \oplus t = \left\{ (y, b(y)) : b(y) = \sum_{x \in X} a(x) \cdot t_y(x),\ y \in Y \right\},$$

where X and Y are coordinate sets, $\mathbb{F}$ is a value set, images a, b $\in \mathbb{F}^X$, $\gamma$ and o are binary associative operators, and template $t \in (\mathbb{F}^X)^X$.

In support for the theorem that follows, suppose $\mathbb{F} \in \{\mathbb{R}, \mathbb{C}, \mathbb{I}_{2k}\}$ and $t \in (\mathbb{R}^X)^X$ denotes a translation invariant template with card $(\mathcal{L}(t_y)) = n$.

For some arbitrary point $y \in X$, let $\{x_1, x_2, \ldots, x_n\} = \mathcal{L}(t_y)$ and for $i = 1, 2, \ldots, n$, set $c_i = t_y(x_i)$.

Define a parameterized template $$\iota : \{1, 2, \ldots, n\} \rightarrow (\mathbb{F}^X)^X \text{ by}$$

-continued $$t(i)_y(x) = \begin{cases} 1, & \text{if } x = x_i \\ 0, & \text{otherwise.} \end{cases}$$

Note that $L(t(i)_y)=\{x_i\}$ for $i=1, 2, \ldots, n$.

THEOREM:

$$a \oplus t = \sum_{i=1}^{n} (a \oplus t(i)) \cdot c_i. \tag{7}$$

PROOF: In order to simplify notation, let $a_i = a \oplus t(i)$. Now, proof that $$a \oplus t = \sum_{i=1}^{n} a_i \cdot c_i.$$

Note that $$\begin{aligned} a_i(y) &= \sum_{x \in X} a(x) \cdot t(i)_y(x) \\ &= \sum_{x \in (t(i)_y)} a(x) \cdot t(i)_y(x) \\ &= \sum_{x \in \{x_i\}} a(x) \cdot t(i)_y(x) \\ &= a(x_i) \cdot t(i)_y(x_i) \\ &= a(x_i). \end{aligned}$$

Thus, $a_i$ is simply a shift of image a, with a(y) being replaced by $a(x_i)$.

Let $b = a \oplus t$ and $$d = \sum_{i=1}^{n} a_i \cdot c_i.$$

Show that $b(y)=d(y)$, $\forall y \in X$. By definition, $$\begin{aligned} b(y) &= \sum_{x \in X} a(x) \cdot t_y(x) \\ &= \sum_{x \in L(t_y)} a(x) \cdot t_y(x) \\ &= \sum_{x \in \{x_1, x_2, \ldots, x_n\}} a(x) \cdot t_y(x) \\ &= \sum_{i=1}^{n} a(x_i) \cdot t_y(x_i) \\ &= \sum_{i=1}^{n} a(x_i) \cdot c_i \\ &= \sum_{i=1}^{n} a_i(y) \cdot c_i \\ &= d(y) \text{ Q.E.D.} \end{aligned}$$

As an easy consequence of this theorem, the following two corollaries can be obtained.

I. Corollary:

(1) If $\textcircled{\gamma} \in \{\boxtimes\ \boxtimes\}$ and $\mathbf{F}$ denotes the appropriate extended real value set for the operation $\textcircled{\gamma}$, then $$a \textcircled{\gamma} t = \prod_{i=1}^{n} (a \oplus t(i)) + c_i \tag{8}$$

(2) If $\textcircled{\gamma} \in \{\boxtimes\ \boxtimes\}$ and $\mathbf{F}$ denotes the appropriate extended real value set for the operation $\textcircled{\gamma}$, then $$a \textcircled{\gamma} t = \prod_{i=1}^{n} (a \oplus t(i)) \cdot c_i \tag{9}$$

Proof: The proof is identical to the proof of the Theorem with the appropriate support at infinity replacing $L(t_y)$ Q.E.D.

II. Corollary: If $\textcircled{\gamma}$ is one of the operations of the Theorem or Corollary I, and $y=x_j$ is an element of the support of $t_y$, then $$a \textcircled{\gamma} t = (a o c_1)\gamma \left[ \prod_{i \neq j}^{n} (a \oplus t(i)) \cdot c_i \right]. \tag{10}$$

4.2. Proof of Phase Only Filter Application

Phase only application is of special interest when spatial light modulators (SLM) are used to provide matched filtering in optical correlation. A SLM can only provide amplitude or phase information unlike a holographic film plate which can provide both simultaneously.

Since the objective of the optical processor described in this paper is to simply shift the image, it is reasonable to assume that phase only SLMs will be sufficient. Recall the definition for the 2-dimensional discrete Fourier transform:

$$H(u, v) = \mathcal{F}[t(x, y)] = \frac{1}{MN} \sum_{x=0}^{M-1} \sum_{y=0}^{N-1} t(x, y) e^{-2j\pi(xu/M + yv/N)}, \tag{11}$$

for $u=0, 1, 2, \ldots, M-1$; $v=0, 1, 2, \ldots, N-1$; and, $j=\sqrt{-1}$, [22].

Let t(x,y) represent the template function, $t_y(x)$, such that, $$t(x, y) = \begin{cases} 1, & \text{if } x = x_0 \text{ and } y = y_0 \\ 0, & \text{otherwise} \end{cases},$$

simply a square pulse of unit width and height located at the position, $(x_o, y_o)$. Then, $$\begin{aligned} H(u, v) = \; & [0 \cdot e^{-2j\pi(0 \cdot u/M + 0 \cdot v/N)} \\ & + 0 \cdot e^{-2j\pi(1 \cdot u/M + 0 \cdot v/N)} \\ & + 0 \cdot e^{-2j\pi(2 \cdot u/M + 0 \cdot v/N)} \\ & \cdot \\ & \cdot \\ & \cdot \\ & + 1 \cdot e^{-2j\pi(x0 \cdot u/M + y0 \cdot v/N)} \\ & \cdot \\ & \cdot \\ & \cdot \\ & + 0 \cdot e^{-2j\pi(xM-1 \cdot u/M + yN-1 \cdot v/N)}], \end{aligned} \tag{12}$$

-continued or, simply $$H(u, v) = e^{-2j\pi(x_0 \cdot u/M + y_0 \cdot v/N)}, \quad (13)$$

for all u=0, 1, 2, . . . , M−1 and v=0, 1, 2, . . . , N−1. Note: the phase function $\phi(u,v) = -2\pi(x_o \cdot u/M + y_o \cdot v/N)$ and the magnitude, $|H(u,v)| = 1$ (i.e., phase only).

Now, consider the known transform pair for the translation properties of the Fourier transform, [22]

$$f(x,y)e^{2j\pi(xu_0/M + yv_0/N)} \longleftrightarrow F(u-u_0, v-v_0)$$

and $$f(x-x_0, y-y_0) \longleftrightarrow F(u,v)e^{-2j\pi(x_0u/M + y_0v/N)}.$$

Therefore, since f(x,y) represents the input image a to the proposed optical processor and H(u,v) represents the results of transforming the spatial template t, then multiplying the Fourier transform of image, f(x,y), by the exponential equivalent of H(u,v) and taking the inverse transform moves the origin of the image to $(x_0, y_0)$. This is precisely what takes place.

4.3. All Digital Implementation

Figure 8:
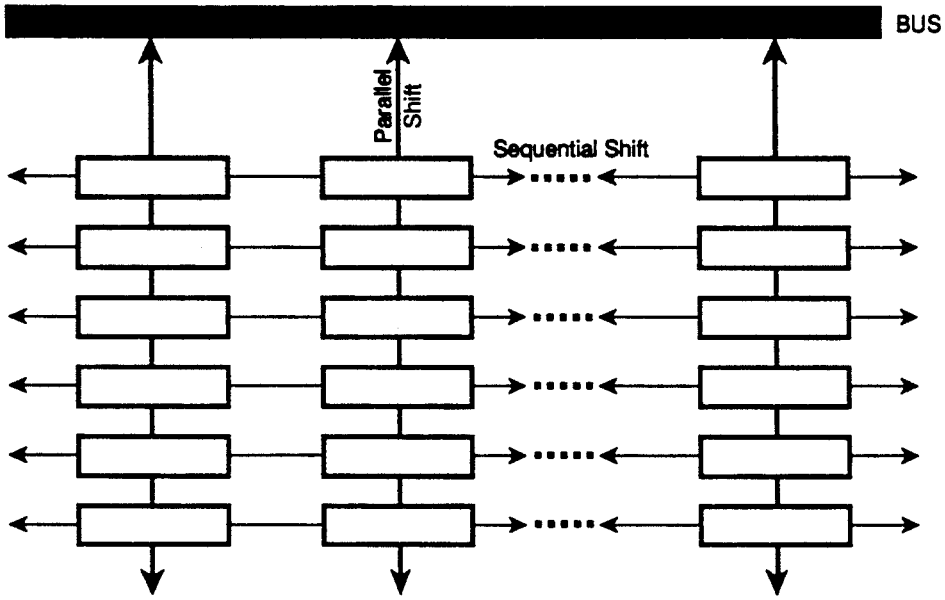
FIG. 8 is a diagram of shift register array.

An all digital configuration simply eliminates the optical analog processor and establishes interprocessor communication at the weighting processor, register number 2, in FIG. 4. Each respective register is initially loaded from a dedicated bus line as depicted in FIG. 8. Additional serial connections are made to each register from the respective accumulator in each accumulation processor.

The advantages of an all digital design are many; generally speaking, it gives the concept greater flexibility in the types of image processing problems it can handle. Thus, it provides a wider application of the design.

The primary design problem this implementation brings is the bandwidth of the bus. Once again the specific instance of the type of application varies greatly. If the instance is a dedicated process, the bus can be tailored for a very high bandwidth. On the other hand, should the instance be an integration with an existing bus structure (such as a workstation or personal computer), then design considerations must change with regard to processing the information as it is being loaded (another level of pipelining).

4.4. Example Operation

FIG. 7., demonstrates the processing steps involved in performing a general convolution operation. The example is for convolution, notice however, that by proper selection of operation paring (i.e.; + with ∨, ·with ∨, ·with ∧, and + with ∧) additive maximum, multiplicative maximum, multiplicative minimum, and additive minimum can be produced in the same fashion.

4.5. Comparison of Execution with RISC Performance

There are currently two limiting factors concerning the proposed architectural design. The major limitation is the switching speed of the spatial light modulators. The best SLMs in the research community today will operate at a 40 KHz switching frequency [proprietary source information]. This is well below the expected operating speed of the remaining digital components, a common 25 MHz clock frequency. The other, a lesser factor, limitation is the memory I/O speed which will be necessary to load in parallel the SLMs and the digital array processors. High speed circuits such as cross-bar switching, block memory transfer, and column parallel loading networks do exist for this application; however, the level of sophistication of the implementation will be the real determination. The 40 KHz switching frequency will be the anticipated limiting factor for the rest of the discussion. It will determine the time spent in each section of the pipeline (refer to FIG. 2.).

Since the proposed design is dependent upon the size of the template configuration and independent of image size, the following equation can be used to estimate the computation time for a convolution type operation:

$$\text{time} = (n+1) \cdot \frac{1}{\text{clock}}, \quad (14)$$

where n is the number of elements in the template and the clock is 40 KHz. The addition is the last stage of the pipeline, the beginning of the pipeline bypasses the analog processor (see corollary, section 4.1). Table 5, show the results for 5 and 25 element templates.

TABLE 5

| Estimated execution time for proposed design | |
|---|---|
| Number of elements | Time (seconds) |
| 5 | $1.5 \times 10^{-04}$ |
| 25 | $6.5 \times 10^{-04}$ |

The following equation can be used to estimate the computation time for a naive calculation of a template convolution over an N×N image using a Reduced Instruction Set sequential Computer (RISC):

$$\text{time} = 2^{2j-1} \frac{(2n-1)}{\text{clock}}, \quad (15)$$

where $j = \log_2(N)$, n is the number of template elements (n multiplications and n−1 additions), the −1 in the exponent represents memory interleaving, the clock frequency is 25 MHz, and 1 clock cycle per operation. Table 6, shows the results for 5 and 25 elements over j values ranging from 6 to 10.

TABLE 6

| Estimated execution time for RISC design | | |
|---|---|---|
| Number of elements | Time (sec.) per image size | |
| 5 | $7.4 \times 10^{-4}$ | 64 × 64 |
| | 0.003 | 128 × 128 |
| | 0.012 | 256 × 256 |
| | 0.047 | 512 × 512 |
| | 0.189 | 1024 × 1024 |
| 25 | 0.004 | 64 × 64 |
| | 0.016 | 128 × 128 |
| | 0.064 | 256 × 256 |
| | 0.257 | 512 × 512 |
| | 1.028 | 1024 × 1024 |

Clearly, there exists a substantial increase in throughput for the proposed design. The interesting speculation is how the throughput would increase with better performance from the SLMs. Even more so if an all digital design could provide the shifting operation being done by the analog processor at mega hertz frequencies.

ALGORITHM DESCRIPTION AND EVALUATION

The max-min sharpening transform is selected as a representative algorithm. Such an algorithm is typically used as a preprocessing filter for the subsequent correlation action. The transform is an image enhancement technique that brings fuzzy gray level objects into sharp focus. This is an iterative technique that compares the maximum and minimum gray level values of pixels contained in a small neighborhood about each pixel in the image. The results of the comparison establishes the respective pixel output. The benefit of its use as a preprocessing step is the sharper the image is that is presented to the correlator, the higher the signal to noise ratio is on the correlation plane (i.e., higher probability of identification).

DESCRIPTION

The image algebra formulation is defined as follows:

Let $a \in \mathbb{R}^X$ be the input image, and N(x) a predetermined neighborhood function of $x \in \mathbb{I}^2$, and $t: \mathbb{I}^2 \rightarrow \mathbb{R}^{Z2}$ be defined by $$t_x(x) = \begin{cases} 0 & \text{if } x \in N(x) \\ -\infty & \text{otherwise} \end{cases}.$$

The output image s is the result of the max-min sharpening transform given by the following algorithm:

$$a_M := a \boxtimes t$$

$$a_m := a \boxtimes t^*$$

$$b := a_M + a_m - 2 \cdot a$$

$$s := \chi_{\leq 0}(b) \cdot a_M + \chi_{>0}(b) \cdot a_m.$$

where $t^*$ is the additive dual of t such that if, in general, $t \in (\mathbb{R}^X_{-\infty})^Y$, then $t^* \in (\mathbb{R}^X_{+\infty})^Y$, and vise versa. For this specific implementation, both the input and the output images are defined on the point set X which corresponds to the coordinate points of the CCD array. Therefore, points which lie outside X are of no computational significance and $t^*$ is considered equal to t. The algorithm is now iterated until s stabilizes (i.e., no change in gray value for any additional iteration).

Figure 10:
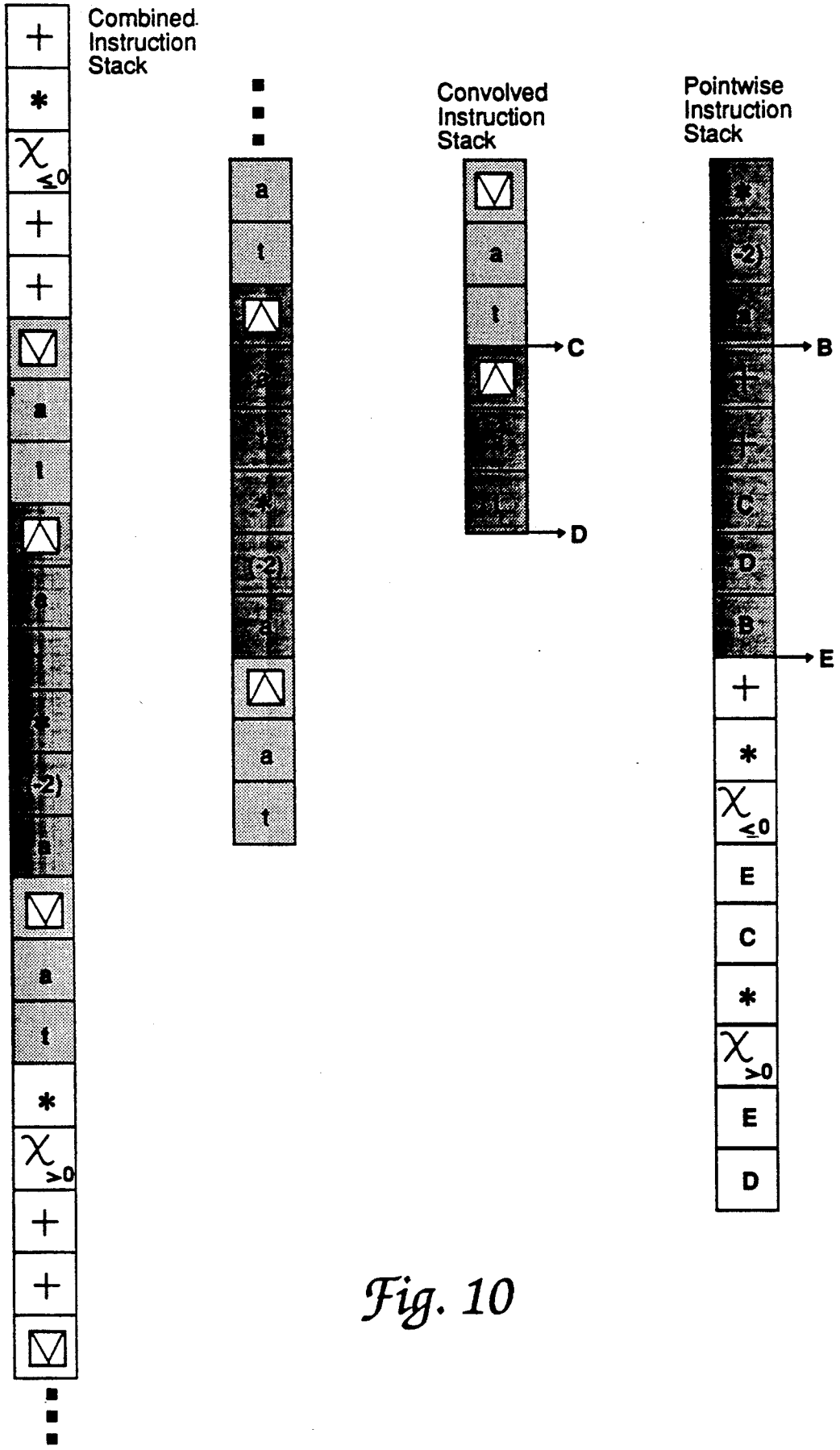
FIG. 10 is a diagram showing an example of instruction stack reordering.

FIG. 10 depicts a typical input stream for the instruction to execute the above algorithm. An instruction stack in prefix notation is used to illustrate the instruction stream. This is a simplification of what would normally take place in a series of translations from the high level algebraic abstraction to the machine instruction level.

After an initial scan of the stack, the stack operations can be separated into general matrix production type operations and those that are strictly point-wise. By sequentially ordering these classes of operations (general matrix operations first) and further noting the number of repetitive operation substrings, the stack can be reconfigured (refer to FIG. 10) to execute with the minimal number of clock cycles per operation.

4.6. Special Case Operations

Certain implementations of the proposed architecture may require a very limited set of operations or a restrictive image type. Two operational cases to review are the case where the image input is strictly binary, the other concerns image processing operations where the templates are always predetermined and higher throughput rates are necessary (Vander Lugt optical system).

4.6.1. Boolean Implementation

In this instance where the imagery is all binary, many of the system functions and the associated hardware can be reduced. First of all, the analog processor is greatly simplified primarily by the use of binary phase only spatial light modulators [6]. These SLMs are much easier to produce and operate at several orders of magnitude faster than those requiring $2^8$ bits of precision. Secondly, the complexity of the ALUs, the buffering from serial to parallel, and the number of connections are greatly reduced. Finally, certain operations can be simplified as well. For instance, the morphological operations of erosion and dilation, usually performed using the algebraic operations $\boxtimes$, $\boxtimes$ or $\boxtimes$, $\boxtimes$ can be done using only the convolution operator such that the dilation is $$b = \chi_{>0}(a \oplus t), \tag{16}$$

and the erosion is $$b = \chi_{=n}(a \oplus t), \tag{17}$$

where n = the number of non-zero elements in t, $b \in \mathbb{F}^Y$ [7]. The resulting system is a very fast architecture for performing a wealth of morphological and boolean image processing operations.

4.6.2. Holographic Film Implementation

The throughput for the proposed architecture can be increased several orders of magnitude by replacing the SLMs controlling the input of template information with a holographic film plate (i.e., Vander Lugt optical systems) [16]. The reasons for the increase are two fold; first, the template configuration selection can be switched in nanoseconds[13]. Secondly, when considering strictly convolution operations, the complete template (phase and magnitude) can be processed, thus eliminating any iterations. The only limitation is that the template configuration must be known ahead of time, thereby reducing any program controlled dynamic configuration.

4.6.3. Acousto-Optical Implementation

FIG. 9, depicts an acousto-optical analog replacement for the Fourier optical correlator which characterizes the spatial configuration processor. The advantage of this implementation is the removal of SLM switching limitation. The limitation of this configuration is now the speed of the CCD array which is significantly higher than that of the SLM's (on the order of 100 KHz).

5.0. CONCLUSIONS

The intended application for this proposed architecture is in military imaging guidance systems (e.g., passive/active infrared, Forward-Looking-InfraRed, Synthetic Aperture Radar, etc.). The objective of these advanced systems is in the automatic identification or classification of potential targets. In many of these instances the relative closing velocity of the system with respect to the target is so great that algorithmic image processing computations can only be accomplished in some massively parallel fashion. Anything less simply cannot update guidance parameters inside the system response time.

In recent years, much interest has been given to all optical systems whose primary function is very high speed auto-correlation with stored target descriptions (matched filtering in frequency) [9].

The proposed hybrid electro-optical design is an effort to replace the all optical system with one which is capable of robust image processing operation as well as simply cross-correlation. The all digital design is being investigated for its increased flexibility. Once the bus bandwidth issues are resolved, the intent is to integrate the design with a workstation environment. Clearly, there exists a substantial increase in throughput for the proposed design. The interesting speculation is how the throughput would increase with better performance from the SLM's. Even more so if, for instance, a free space, optical crossbar switch design could provide the shifting operation at megahertz frequencies.

REFERENCES

1. Sternberg, S. R., "Overview of image algebra and related issues," in *Integrated Technology for Parallel Image Processing*, (S. Levialdi, Ed.), Academic Press, London, 1985.
2. Serra, J., *Image Analysis and Mathematical Morphology*, Academic Press, London, 1982.
3. Minkowski, H., "Volumen und Oberflache," *Math. Ann.* 57, 1903, 447–495.
4. Huang, K. S., Jenkins, B. K., and Sauchuch, A. A., "Binary Image Algebra and Optical Cellular Logic Processor Design," *Computer Vision, Graphics, and Image Processing*, vol. 45, no. 3, March 1989.
5. Ritter, G. X., Wilson, J. N., and Davidson, J. L., "Image Algebra: An Overview," *Computer Vision, Graphics, and Image Processing*, vol. 49, pp. 297–331 (1990).
6. Feitelson, D. G., *Optical Computing A Survey for Computer Scientists*, The MIT Press, Cambridge, Mass., 1988.
7. Davidson, J. L., *Lattice Structures in the Image Algebra and Applications to Image Processing*, Ph.D. dissertation, University of Florida, Gainesville, Fla., 1989.
8. Goodman, J. W., *Introduction to Fourier Optics*McGraw-Hill, San Francisco, Calif., 1968.
9. Butler, S. F., *Production and Analysis of Computer-Generated Holographic Matched Filters*, Ph.D. dissertation, University of Florida, Gainesville, Fla., 1989.
10. Ritter, G. X., Wilson, J. N., and Davidson, J. L., *Standard Image Processing Algebra—Document Phase II*, TR(7) Image Algebra Project, F08635-84-C-0295, Eglin AFB, Fla., 1987 (DTIC).
11. Li, D., *Recursive Operations in Image Algebra and Their Applications to Image Processing*, Ph.D. dissertation, University of Florida, Gainesville, Fla., 1990.
12. Ritter, G. X., Wilson, J. N., and Davidson, J. L., *Image Algebra Synthesis*, Air Force Armament Laboratory, Eglin AFB, Fla., March Image Algebra Synthesis, 1989 (DTIC).
13. Casasent, D., "Optical morphological processors," in *Image Algebra and Morphological Image Processing*, vol. 1350, of Proceedings of *Soc. of Photo -Optical Instrumentation Engineers*, San Diego, Calif., July, 1990.
14. Gader, P. D., *Image Algebra Techniques for Parallel Computation of Discrete Fourier Transforms and General Linear Transforms*, Ph.D. dissertation, University of Florida, Gainesville, Fla., 1986.
15. Shrader-Frechette, M. A. and Ritter, G. X., "Registration and rectification of images using image algebra," in *Proc. IEEE Southeast Conf.*, Tampa, Fla., 1987, 16–19.
16. Vander Lugt, A., "Signal detection by complex spatial filtering," *IEEE Trans. Information Theory*, IT-10, pp. 139–145, 1964.
17. Hecht, E. and Zajac, A., *Optics*, Addison-Wesley, Reading, Mass., 1979.
18. Coffield, P., "An electro-optical image processing architecture for implementing image algebra operations," in *Image Algebra and Morphological Image Processing II*, vol. 1568, of Proceedings of *Soc. of Photo-Optical Instrumentation Engineers*, San Diego, Calif., July, 1991.
19. Stone, H. S., *High Performance Computer Architecture*, Addison-Wesley, Reading, Mass., 1987.
20. Roth, C. H., *Fundamentals of Logic Design*, West Publishing Co., St. Paul, Minn., 1979.
21. Hayes, J. P., *Computer Architecture and Organization*, McGraw-Hill, New York, N.Y., 1988.
22. Wilson, J. N., "On the generalized matrix product and its relation to parallel architecture communication," in *Image Algebra and Morphological Image Processing*, vol. 1350 of Proceedings of *Soc. of Photo-Optical Instrumentation Engineers*, San Diego, Calif., July, 1990.
23. Huang, K. S. *A Digital Optical Cellular Image Processor, Theory, Architecture and Implementation*, World Scientific, Singapore, 1990.
24. Hillis, W. D., *The Connection Machine*, MIT Press, Cambridge, Mass., 1985.
25. Bertsekas, D. P. and Tsitsiklis, J. N., *Parallel and Distributed Computation Numerical Methods*, Prentice Hall, Englewood Cliffs, N. J., 1989.
26. Maragos, P. and Schafer, R. W., "Morphological filters-Part I:Their set-theoretic analysis and relations to linear shift-invariant filters," *IEEE Trans. Acoust., Speech, and Signal Processing*, vol. ASSP-35, pp. 1153–1169, Aug. 1987.
27. Maragos, P. and Schafer, R. W., "Morphological filters-Part II:Their relations to median, order statistics, and stack-filters," *IEEE Trans. Acoust., Speech, and Signal Processing*, vol. ASSP-35, pp. 1170–1185, Aug. 1987, corrections vol. ASSP-37, p. 597, Apr. 1989.
28. Ritter, G. X., "Heterogeneous matrix products," in *Image Algebra and Morphological Image Processing II*, vol. 1568, of Proceedings of *Soc. of Photo-Optical Instrumentation Engineers*, San Diego, Calif., July, 1991.

It is understood that certain modifications to the invention as described may be made, as might occur to one with skill in the field of the invention, within the scope of the appended claims. Therefore, all embodiments contemplated hereunder which achieve the objects of the present invention have not been shown in complete detail. Other embodiments may be developed without departing from the scope of the appended claims.

What is claimed is:

1. A logical computer architecture for image and signal processing, and other related computations, using a data flow concept for performing operations of an image algebra having an algebraic set of operators; wherein the architecture comprises three tightly coupled processing components: a spatial configuration processor (process S), a weighting processor using a point-wise operation (process W), and an accumulation processor (process A), wherein the data flow and image processing operations are directed by a control buffer and pipelined to each of said three processing components;

wherein the spatial configuration processor has an input for an original image and an input for a template, and in operation uses a step-wise discrete convolution of the original input image with each template location, with a unit value assigned to a template element for each convolution, a result of each convolution being a shift of an input image element, providing an output of the spatial configuration processor which is coupled to the weighting processor;

wherein the output of the spatial configuration processor is combined point-wise in the weighting processor, using an appropriate binary associative operator from the algebraic set of operators, with the value of the respective template element, the operation of the weighting processor being an array process execution using said appropriate binary associative operator, the weighting processor having an output coupled to the accumulation processor;

wherein the output of the weighting processor is accumulated point-wise in the accumulation processor, using an appropriate global reduce operator from the algebraic set of operators, the accumulation processor having an accumulator memory which, once the final template element is processed, contains the result of a generalized matrix product defined in the image algebra.

2. A logical computer architecture according to claim 1, wherein the spatial configuration processor is an optical system which comprises a light source providing a coherent collimated light beam which passes through a polarizer to provide a plane wave of polarized coherent light to a first spatial light modulator, said input for an original image being coupled to the first spatial light modulator, to provide a first phase modulated output which is passed to a first Fourier transform lens, light energy from the first Fourier transform lens being passed to a second spatial light modulator, said input for a template being coupled to the second spatial light modulator, to provide a second phase modulated output which is passed to a second Fourier transform lens, output from the second Fourier transform lens being passed through an analyzer which modifies the intensity of the second phase modulated light, with differing levels of intensity being intercepted by a charge coupled device (CCD) array and converted back to digital form, the CCD array having an output which is the output of the spatial configuration processor as a digital electronic signal.

3. A logical computer architecture according to claim 1, wherein the weighting processor comprises a plurality of weighting processor cells, each of which comprises first, second and third parallel shift registers, and an arithmetic logic unit (ALU) having a multiplier, an adder and a comparator, the first parallel shift register having a scalar input from the control buffer and a parallel output on an n-bit line to the ALU, the second parallel shift register having a digital input connected to the spatial configuration processor and a parallel output on an n-bit line connected to the ALU, and the third parallel shift register having an n-bit parallel input from an output of the ALU and a serial output to the accumulation processor.

4. A logical computer architecture according to claim 3, wherein the accumulation processor is a parallel processor having a plurality of accumulation processor cells, each of which comprises an accumulator and an arithmetic logic unit (ALU), each ALU of the accumulation processor having a directly connected input from the output of a weighting processor cell, an output connected to the accumulator, and an input from the accumulator.

5. A logical computer architecture according to claim 4, wherein the spatial configuration processor is an optical system which comprises a light source providing a coherent collimated light beam which passes through a polarizer to provide a plane wave of polarized coherent light to a first spatial light modulator, said input for an original image being coupled to the first spatial light modulator, to provide a first phase modulated output which is passed to a first Fourier transform lens, light energy from the first Fourier transform lens being passed to a second spatial light modulator, said input for a template being coupled to the second spatial light modulator, to provide a second phase modulated output which is passed to a second Fourier transform lens, output from the second Fourier transform lens being passed through an analyzer which modifies the intensity of the second phase modulated light, with differing levels of intensity being intercepted by a charge coupled device (CCD) array and converted back to digital form, the CCD array having an output which is the output of the spatial configuration processor as a digital electronic signal.

6. A logical computer architecture according to claim 4, wherein the spatial configuration processor is an acousto-optical analog image translation device which comprises a light source providing a coherent collimated light beam which passes through a liquid crystal light valve, first and second lenses, first and second acousto-optical devices, and third and fourth lenses to a charged coupled device (CCD) array;

said input for an original image being coupled to the liquid crystal light valve, said input for a template being coupled to the first and second acousto-optical devices to provide digital electronic signals as vertical signals to one of the acousto-optical devices and horizontal signals to the other acousto-optical device, the acousto-optical devices being oriented 90 degrees apart; the CCD array having an output which is the output of the spatial configuration processor to provide an output image in digital form.

7. A logical computer architecture according to claim 4, wherein the spatial configuration processor is an all digital system which comprises a single instruction multiple data array of interconnected parallel shift registers that establishes inter-processor communication at the weighting processor, additional serial connections are made to each parallel shift register from the respective accumulator in each accumulation processor;

said input for an original image being coupled to the array of parallel shift registers from a dedicated bus line, said input for a template being coupled to a correct single instruction shift of the contents of each parallel shift register in the array in cardinal directions north, south, east, and west to provide the appropriate input to the weighting processor.

* * * * *

UNITED STATES PATENT AND TRADEMARK OFFICE

CERTIFICATE OF CORRECTION

PATENT NO. : 5,262,968

DATED : November 16, 1993

INVENTOR(S) : Patrick C. Coffield

It is certified that error appears in the above-identified patent and that said Letters Patent is hereby corrected as shown below:

Column 9, line 56, delete one occurrence of "choice".
Column 10, line 48, change the first occurrence of "=" to --±--.
Column 11, line 24, insert --∈-- after "t".
Column 12, line 23 "⊠ and ⊗" should be --⊠ and ⊘--.
Column 13, Table 1, line 18, correct the spelling of "scalar".
Column 16, line 61, "$R^X$" should be --$F^X$--.
Column 17, line 26, insert --L-- before "(t(i)y)".
Column 23, line 34, insert a comma and a space after "Optics".

Signed and Sealed this

Twenty-fourth Day of May, 1994

Bruce Lehman

*Attest:*

BRUCE LEHMAN

*Attesting Officer*

*Commissioner of Patents and Trademarks*